US010138035B2

(12) United States Patent
Loukov

(10) Patent No.: US 10,138,035 B2
(45) Date of Patent: Nov. 27, 2018

(54) TAMPER EVIDENT FLIP-TOP CLOSURE, METHOD AND TOOL FOR MAKING THE SAME

(71) Applicant: Stefan Loukov, Coram, NY (US)

(72) Inventor: Stefan Loukov, Coram, NY (US)

( * ) Notice: Subject to any disclaimer, the term of this patent is extended or adjusted under 35 U.S.C. 154(b) by 0 days.

(21) Appl. No.: 15/821,348

(22) Filed: Nov. 22, 2017

(65) Prior Publication Data

US 2018/0155094 A1 Jun. 7, 2018

Related U.S. Application Data

(63) Continuation-in-part of application No. 14/313,355, filed on Jun. 24, 2014, now Pat. No. 9,828,146.

(51) Int. Cl.

| | |
|---|---|
| ***B65D 41/46*** | (2006.01) |
| ***B65D 50/06*** | (2006.01) |
| ***B65D 55/16*** | (2006.01) |
| ***B65D 41/48*** | (2006.01) |
| ***B65B 7/28*** | (2006.01) |
| ***B65D 47/08*** | (2006.01) |

(52) U.S. Cl.

CPC ..... *B65D 50/062* (2013.01); *B65B 7/2821* (2013.01); *B65D 41/485* (2013.01); *B65D 47/0838* (2013.01); *B65D 55/16* (2013.01); *B65D 2101/0076* (2013.01)

(58) Field of Classification Search

CPC ..... B65D 51/18; B65D 41/32; B65D 41/325; B65D 41/3447; B65D 41/405; B65D 41/48; B65D 41/485; B65D 41/3438; B65D 41/3433; B65D 41/3428; B65D 41/3423; B65D 2101/0076; B65D 2101/0069; B65D 43/0235; B65D 43/0237; B65D 43/0254; B65D 43/0281; B65D 2251/0015

See application file for complete search history.

(56) References Cited

U.S. PATENT DOCUMENTS

| | | | |
|---|---|---|---|
| 4,732,289 | A | 3/1988 | Granat |
| 5,271,536 | A | 12/1993 | Wilson |
| 5,992,659 | A | 11/1999 | Nofer |
| 6,334,555 | B1 | 1/2002 | Randall |
| 6,347,716 | B1 | 2/2002 | Nofer |

(Continued)

FOREIGN PATENT DOCUMENTS

| | | | | |
|---|---|---|---|---|
| DE | 3224002 | A1 * | 12/1983 | ..... B65D 41/014 |
| WO | WO 2012131097 | A1 * | 10/2012 | ..... B65D 47/0838 |

*Primary Examiner* — J. Gregory Pickett
*Assistant Examiner* — Allan Stevens
(74) *Attorney, Agent, or Firm* — The Farrell Law Firm, P.C.

(57) ABSTRACT

A closure is provided for a container. The closure includes a base having a substantially cylindrical shape with a recessed area along a top perimeter of the base. The closure also includes a lid configured to close over and open off of the base. The closure further includes a tab that extends from a lower surface of the lid and includes a lip portion configured to fold back onto the tab and lock with the base when the lid is closed over the base. The tab detaches from the lid when opening the lid from the base after the lip portion is folded back onto the tab. A portion of the outer surface of the tab is visible through the at least one recessed area after the lid is closed over the base and remains partially visible after the tab has detached from the lid.

10 Claims, 34 Drawing Sheets

(56) References Cited

U.S. PATENT DOCUMENTS

| | | | | |
|---|---|---|---|---|
| 6,481,588 | B1 | 11/2002 | Wagner | |
| 6,848,603 | B2 | 2/2005 | Gaiser | |
| 7,051,888 | B2 | 5/2006 | Antier | |
| 7,344,039 | B2 | 3/2008 | Bixler | |
| 7,469,795 | B2 | 12/2008 | Druitt | |
| 7,611,025 | B2 | 11/2009 | Nusbaum | |
| 8,046,974 | B2 | 11/2011 | Lewis | |
| 8,292,101 | B1 | 10/2012 | Bragg | |
| 8,434,639 | B2 | 5/2013 | Markert | |
| 8,439,212 | B2 | 5/2013 | Clodfelter | |
| 8,490,804 | B2 | 7/2013 | Benoit-Gonin | |
| 8,573,423 | B2 | 11/2013 | McGeough | |
| 2006/0175281 | A1* | 8/2006 | Ekkert ..... | B65D 41/3457 215/252 |
| 2007/0131641 | A1 | 6/2007 | Higgins | |
| 2008/0073382 | A1 | 3/2008 | Higgins | |
| 2008/0093363 | A1 | 4/2008 | Pedlar | |
| 2008/0169261 | A1 | 7/2008 | Druitt | |
| 2009/0152269 | A1 | 6/2009 | Pucci | |
| 2011/0024423 | A1* | 2/2011 | Erspamer ..... | B65D 41/3428 220/266 |
| 2012/0211493 | A1 | 8/2012 | Daggett | |
| 2014/0103005 | A1 | 4/2014 | Cerveny | |

* cited by examiner

TAMPER EVIDENT FLIP-TOP CLOSURE, METHOD AND TOOL FOR MAKING THE SAME

PRIORITY

This application is a Continuation-in-Part Application of U.S. application Ser. No. 14/313,355, which was filed in the U.S. Patent and Trademark Office (USPTO) on Jun. 24, 2014.

BACKGROUND OF THE INVENTION

1. Field of the Invention

The present invention relates generally to a flip-top closure used for a container, and more particularly, to a flip-top closure that provides tamper evidence when opened.

2. Description of the Related Art

Generally, closures, or caps, have been used with corresponding containers, or bottles, in order to seal contents within the bottle. When the closures are opened, access is provided to the interior of the container, and the contents stored therein. Closures have taken a variety of forms, including, for example, screw-top closures and flip-top closures. Screw-top closures are removed completely from the container when opened, while flip-top closures are flipped open and remain partially connected to the container.

Screw-top closures utilize a frangible ring for tamper evidence. The frangible ring breaks away from the closure and remains on the neck of the container, when the screw-top closure is unscrewed and removed. Tamper evidence for flip-top closures is less prevalent. However, several flip-top closures incorporate a removable tamper-evident member. Additional flip-top closures include frangible elements that remain connected to a portion of the flip-top closure.

SUMMARY OF THE INVENTION

The present invention has been made to address at least the above problems and/or disadvantages and to provide at least the advantages described below. Accordingly, an aspect of the present invention provides a flip-top closure that provides tamper evidence when opened.

Another aspect of the present invention provides a method for assembling a flip-top closure over a corresponding neck of a container so that the flip-top closure provides tamper evidence when opened.

According to an aspect of the present invention, a closure is provided for a container that includes a base having a substantially cylindrical shape with at least one recessed area along a top perimeter of the base and a retaining ring near bottom of the base. The closure also includes a lid having an upper surface and a lower surface, and configured to close over and open off of the base. The closure further includes at least one tab having an inner surface and an outer surface. The at least one tab extends from the lower surface of the lid and comprises a lip portion configured to fold back onto the at least one tab through contact with the base and lock with the base, when the lid is closed over the base. The at least one tab is configured to detach from the lid when upward movement of the at least one tab is prevented by the base as the lid is opened from the base after the lid is closed over the base, and a portion of the outer surface of the at least one tab is visible through the at least one recessed area after the lid is closed over the base and remains partially visible through the at least one recessed area after the at least one tab has detached from the lid. The base further includes at least one undercut region disposed surrounding the at least one recessed area and in which the at least one tab is disposed when the lid is closed over the base.

BRIEF DESCRIPTION OF THE DRAWINGS

Aspects, features, and advantages of the present invention will become more apparent from the following detailed description when taken in conjunction with the accompanying drawings in which.

DETAILED DESCRIPTION OF EMBODIMENTS OF THE PRESENT INVENTION

Figure 1:
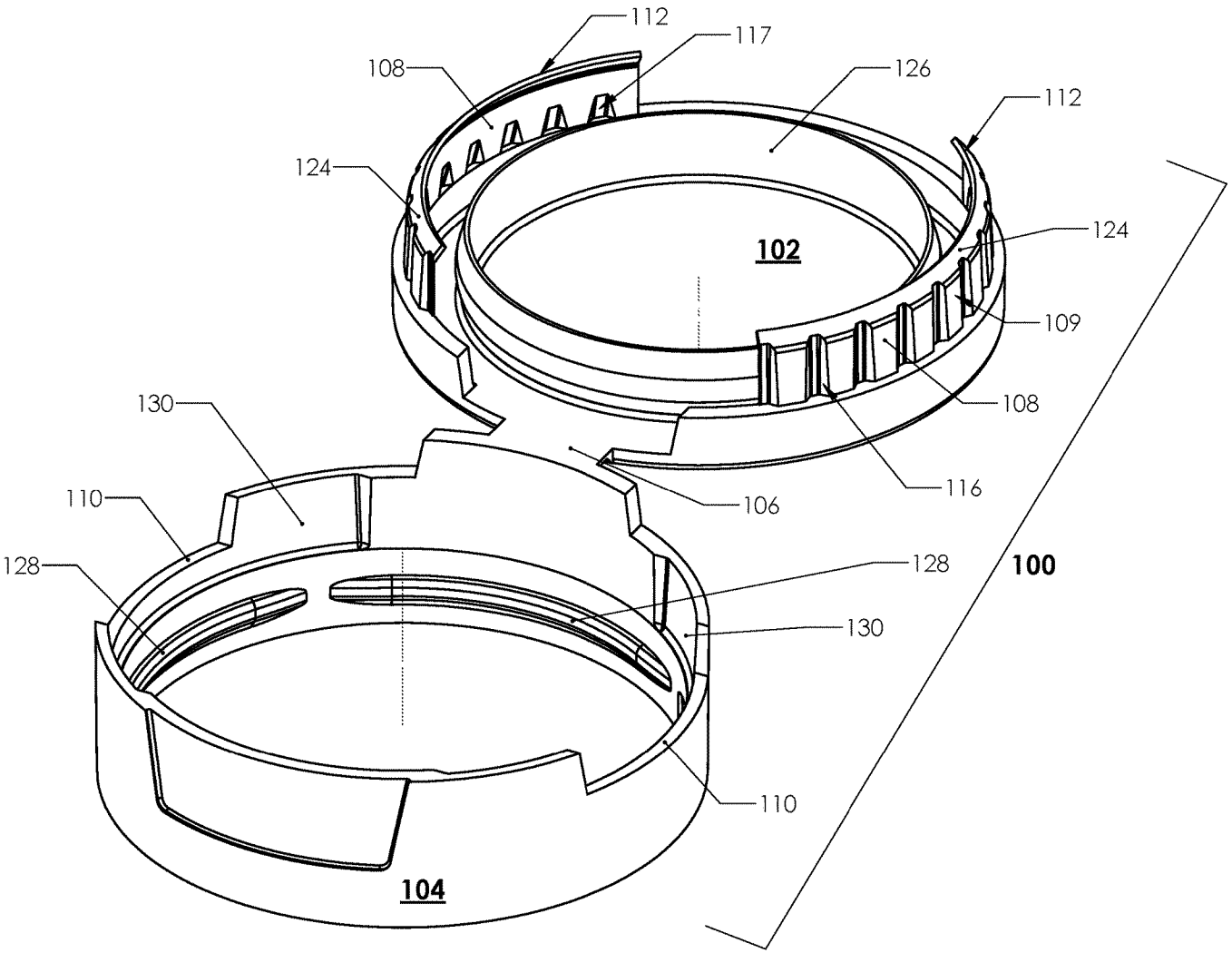
FIG. 1 is a diagram illustrating a tamper-evident flip-top closure in an open state, according to an embodiment of the present invention.

Embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

Referring initially to FIG. 1, a diagram illustrates a tamper-evident flip-top closure in an open state, according to an embodiment of the present invention. Closure 100 includes a base 104 and a lid 102, which are connected with a living hinge 106. The base has a substantially cylindrical shape, and the living hinge 106 enables the closure to function as a flip-top closure. However, alternate embodiments of the present invention may incorporate other connections between the base 104 and the lid 102. A further alternate embodiment of the present invention may not incorporate a permanent connection between the base 104 and the lid 102.

The closure 100 also includes two frangible tamper-evidence tabs 108, which are attached to the inside portion of the lid 102. In alternate embodiments of the present invention, one or more tamper-evidence tabs 108 may be utilized. The closure 100 can be formed integrally by injection molding using suitable material, such as, for example, polypropylene or polyethylene.

Two opposing recessed areas 110 are disposed on an upper surface of the base 104 of the closure 100 coinciding with the placement of the two tamper-evidence tabs 108. Thus, the number of recessed areas can be equivalent to the number of tamper-evidence tabs, and alternate embodiments of the present invention may incorporate one or more recessed areas. Two opposing undercut areas 130 are disposed on an inside surface of the base 104 surrounding corresponding recessed areas 110. Thus, the number of undercut areas is equivalent to the number of tamper-evidence tabs, and alternate embodiments of the present invention may incorporate one or more undercut areas. The size and location of the undercut areas 130 enable the lid 102 to be closed over the base 104 by serving as receptacles for the frangible tamper-evidence tabs 108. A retaining ring 128 is disposed on an inner surface of the base 104, near a bottom end of the base 104, for retaining the closure 100 on a container.

As shown on FIG. 1, free ends of the tamper-evidence tabs 108 are formed as lip portions 124, which are in an inwardly angled relative to the base 104. The tamper-evidence tabs 108 have a thickness that increases as distance increases from a lower surface of the lid 102. Thus, the tamper-evidence tabs 108 adjoin the lid 102 with at a thinnest point. The thinness of the tamper-evidence tabs is created by external cut-outs 116 of external surface 109, and internal cut-outs 117. The external cut-outs 116 and the internal cut-outs 117 have areas that decrease as distance increases from the lower surface of the lid 102. While the cut-outs are shown as specific shapes in the embodiment of FIG. 1, any shape may be utilized as long as the thickness of the tamper-evidence tabs 108 is smallest at a point where it is to detach from the lid 102.

A plug seal 126 is disposed as a ring within a perimeter of the tamper evidence tabs 108, and extending from the lid 102, for a sealing engagement with a neck of a container. The shape and size of the plug seal 126 may be modified in accordance with the shape and size of the neck of the container that it is to seal.

Figure 2B:
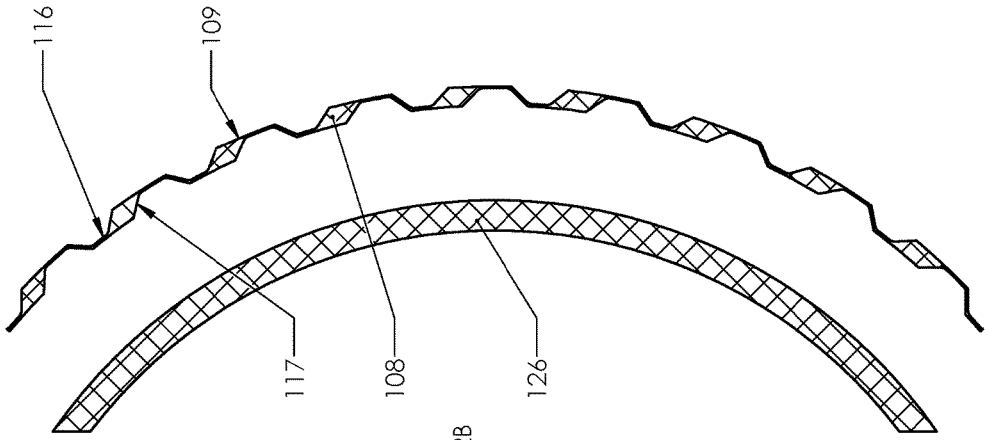
FIG. 2B is a diagram illustrating a rupture line of the tamper-evidence tabs of FIG. 2A, according to an embodiment of the present invention.
Figure 2A:
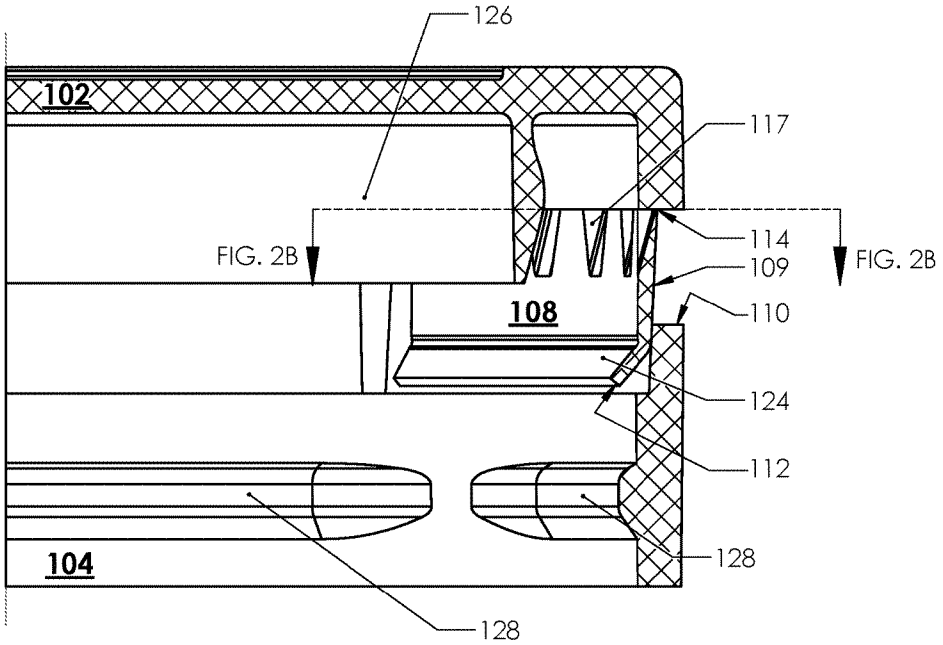
FIG. 2A is a diagram illustrating a partial view in cross-section of the tamper-evident flip-top closure of FIG. 1, in a closed state, according to an embodiment of the present invention.

Referring now to FIG. 2A, a diagram illustrates a partial view in cross-section of the tamper evident flip-top closure of FIG. 1, in closed state, according to an embodiment of the present invention. The cross-section shows the relative position of the main elements of the closure 100 before being assembled on a container.

When the lid 102 is closed over the base 104 of the closure 100, the two frangible tamper-evidence tabs 108 are disposed in the undercut areas 130 within the base 104. The external sides 109 of the tamper-evidence tabs 108 are in contact with and supported by surfaces of the undercut areas 130 of the base 104. The added support from the base 104 on the tamper-evidence tabs 108 provides necessary latitudinal stiffness for proper functionality of the closure-container assembly, as described in greater detail below. The tamper-evidence tabs 108 are purposely thin walled for great flexibility in a lateral direction and stiffness and rigidity in a longitudinal direction. As shown in FIG. 2A, there is no additional retention of the lid 102 in base 104 of the closure 100 that would provide tamper-evidence. Also, as described in greater detail below with reference to FIGS. 8A-8C, the design of the tamper-evidence tabs 108 facilitates the construction of the tool for injection molding, allowing for natural sharpness on a tamper-evidence tab edge 112, as shown on FIG. 1.

Existing closures with tamper-evidence rings are crafted with rounded or slanted retaining edges, because of the requirements for stiffness of the tamper-evidence ring for functionality and ease of de-molding. Thus, a relatively thick section of the tamper-evidence tabs 108 is required for stiffness and trial-and-error adjustments of the slant angle and radius of the edge for the specific closure-container combination, which is costly and time consuming.

FIG. 2B is a diagram illustrating a rupture line of the tamper-evidence tabs of FIG. 2A, according to an embodiment of the present invention. Opening the lid 102 leads to rupture of the tamper-evidence tabs 108 from the lid 102 along a line 114, as shown in FIG. 2A. FIG. 2B depicts a cut face of the section line from FIG. 2A. The cross section of the tamper-evidence tabs 108 weakens gradually as it approaches the lid 102 through the placement of sequentially spaced external cut-outs 116 and internal cut-outs 117 of the tamper evidence tabs 108.

Figure 3:
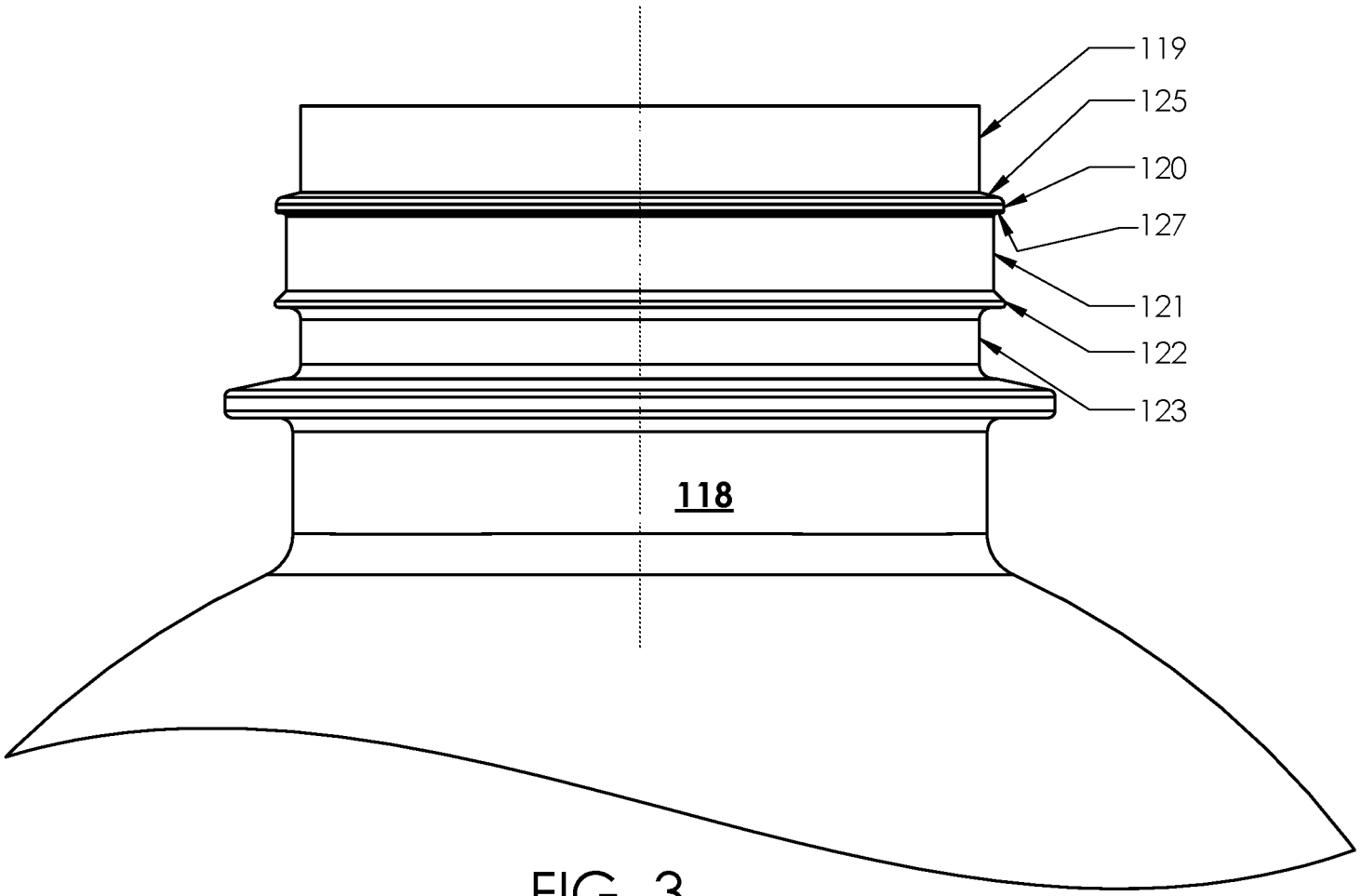
FIG. 3 is a diagram illustrating a front view of a neck of a container to which the closure of FIG. 1 is assembled to form a sealed package.

Referring now to FIG. 3, a diagram illustrates a front view of a neck of a container to which the closure of FIG. 1 is assembled to form a sealed package. A neck finish 118 of the container features an upper ring 120 and lower ring 122. A portion 121 of the neck finish 118 between the upper ring 120 and the lower ring 122 has a larger diameter than an upper area 119 disposed above the upper ring 120 or a lower area 123 disposed below the lower ring 122.

FIGS. 4A-4F are a series of diagrams illustrating application and locking of the closure to the neck of a container, according to an embodiment of the present invention.

Figure 4A:
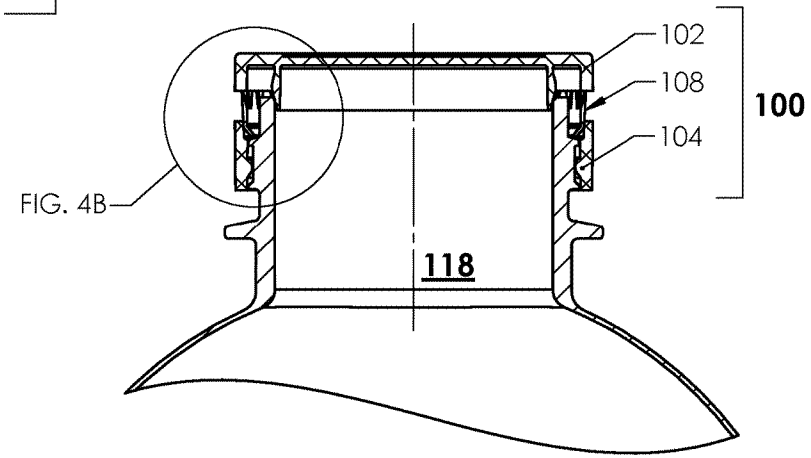
FIGS. 4A-4F are a series of diagrams illustrating application and locking of the closure to the neck of a container, according to an embodiment of the present invention.

As illustrated in FIG. 4A, the closure 100 is assembled to the neck finish 118 of the container. The lid 102 is closed over the base 104 of the closure 100, and is retained in place by the friction between the external surfaces 109 of the tamper-evident tabs 108 and the internal surfaces of the undercut area 130 of the base 104, as shown in FIG. 1.

Figure 4B:
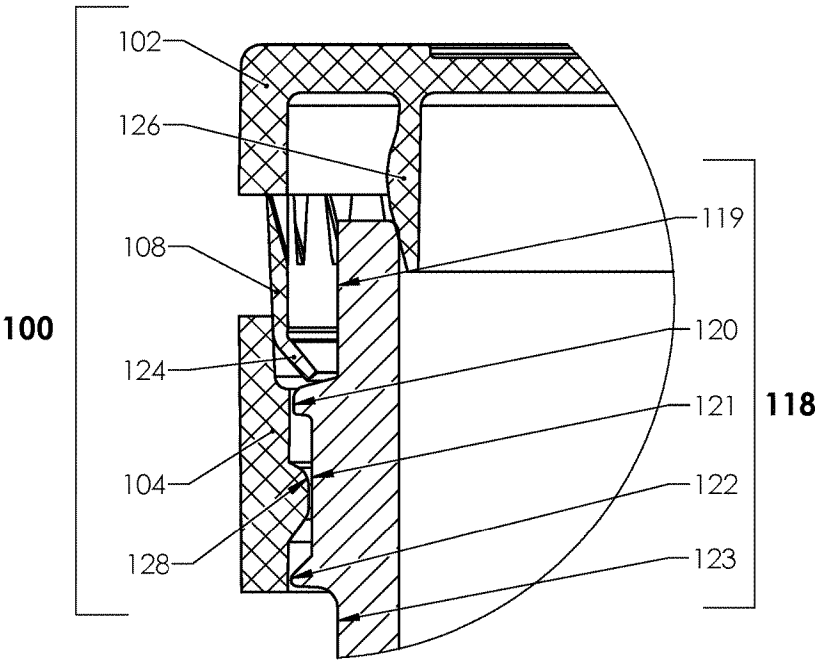

As illustrated in greater detail in FIG. 4B, the retaining ring 128 of the base 104 is disposed between the upper ring 120 and the lower ring 122 of the neck finish 118 of the container, ensuring that the closure 100 remains in place relative to the container. This feature allows the entire container-closure package to be produced and shipped in a semi-assembled state.

For example, the container-closure package of FIGS. 4A and 4B may be shipped in the semi-assembled state to a drug-store, where a pharmacist is able to open the lid 102 to place medication within the container, and then seal the closure 100 with tamper-evidence by pressing the closure 100 further over container.

As shown in FIG. 4B, the lip portions 124 of the tamper-evidence tabs 108 are in close proximity to an upper surface 125 of the upper ring 120. The upper surface 125 is configured with a slight slant upwardly toward the neck finish 118.

Figure 4C:
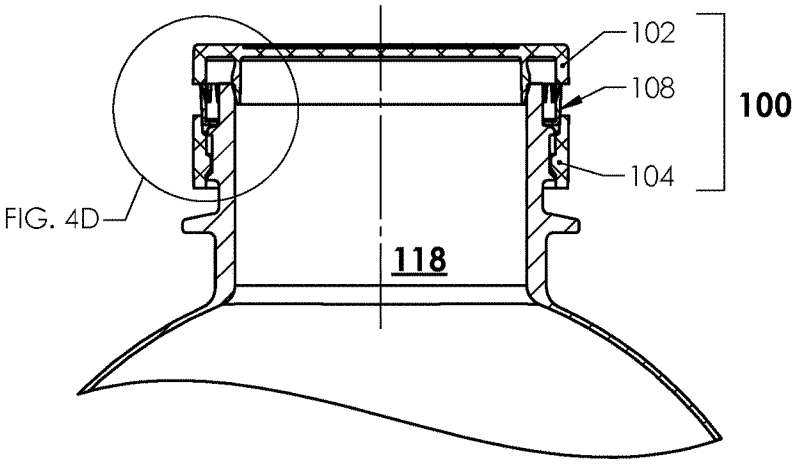
Figure 4D:
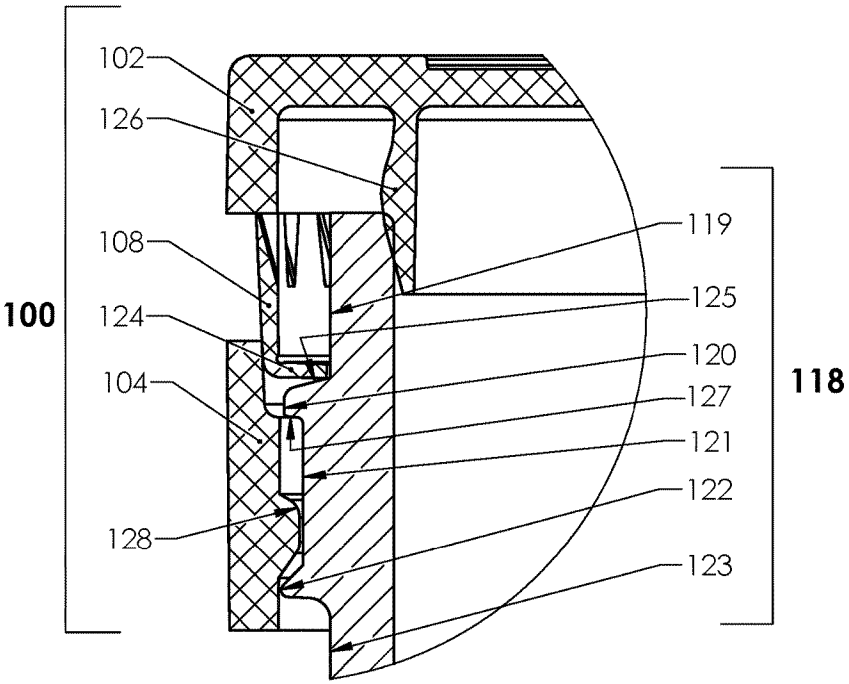

Referring now to FIGS. 4C and 4D, upon further assembly of the closure 100 over the neck finish 118, as the closure 100 is pushed further over the container, the lip portions 124 of tamper-evidence tabs 108 folds inwardly due to resistance caused by the upper ring 120 of the neck finish 118.

Figure 4E:
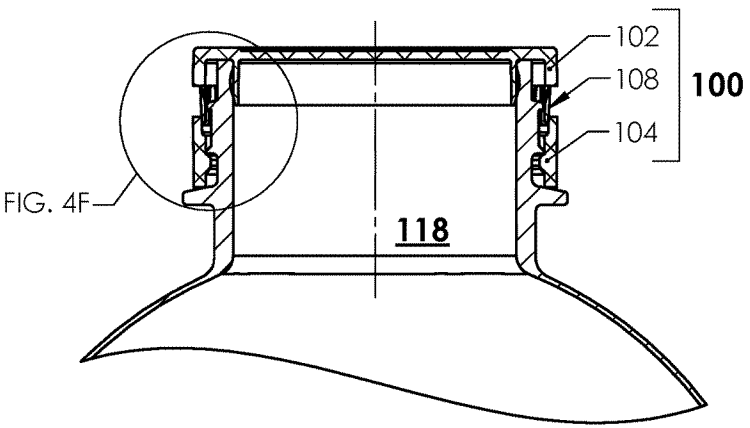
Figure 4F:
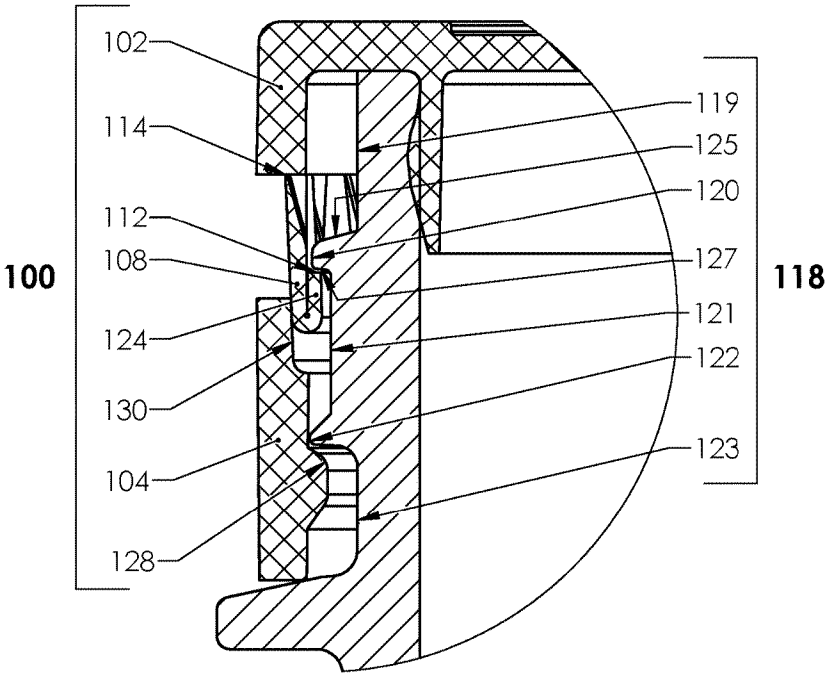

As shown in FIGS. 4E and 4F, the closure 100 is fully assembled over the neck finish 118 of the container. The retaining ring 128 of the base 104 of the closure is snapped under the lower ring 122 of the neck finish 118. The lip portions 124 of the tamper-evidence tabs 108 are folded fully back onto the tamper evidence tabs 108, both of which are constrained between the interior walls of the undercut areas 130 of the base 104, a lower surface 127 of the upper ring 120 of the neck finish 118, and the portion 121 of the neck finish 118 between the upper ring 120 and the lower ring 122.

Figure 5:
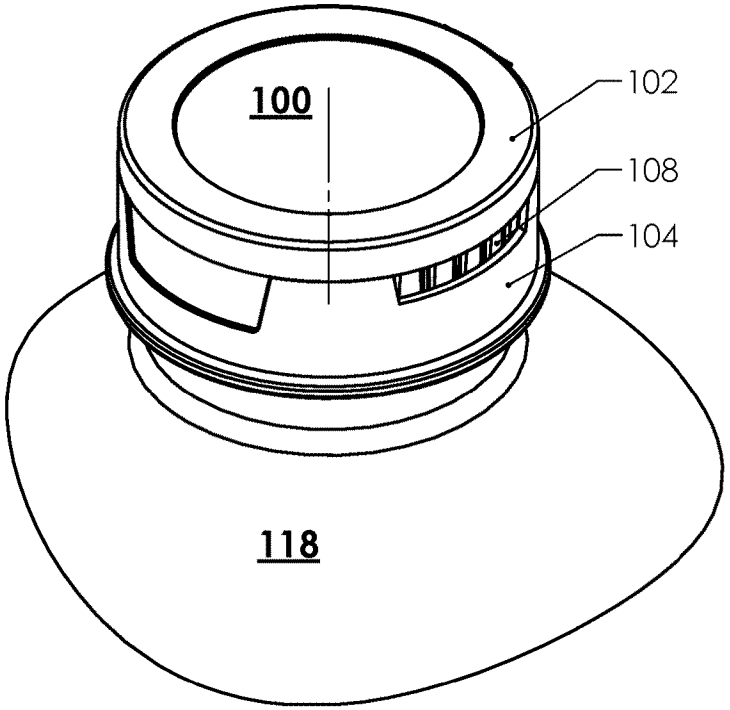
FIG. 5 is a diagram illustrating an isometric view of the tamper-evident flip-top closure in a closed and assembled state, according to an embodiment of the present invention.

FIG. 5 is diagram illustrating an isometric view of the tamper-evident flip-top closure in a closed and assembled state, according to an embodiment of the present invention.

The base 104 is permanently assembled over the neck finish 118 of the container, and the lid 102 is closed over the base 104 with the plug seal 126 engaged within an inner diameter of the neck finish 118. The recessed areas 110 of the base 104 allow for a visual check to determine whether a seal between the lid 102 and container was tampered with. Any consequent opening of the lid 102 leads to a rupture of the tamper-evidence tabs 108 along lines 114, as described above with reference to FIG. 2B.

Figure 6:
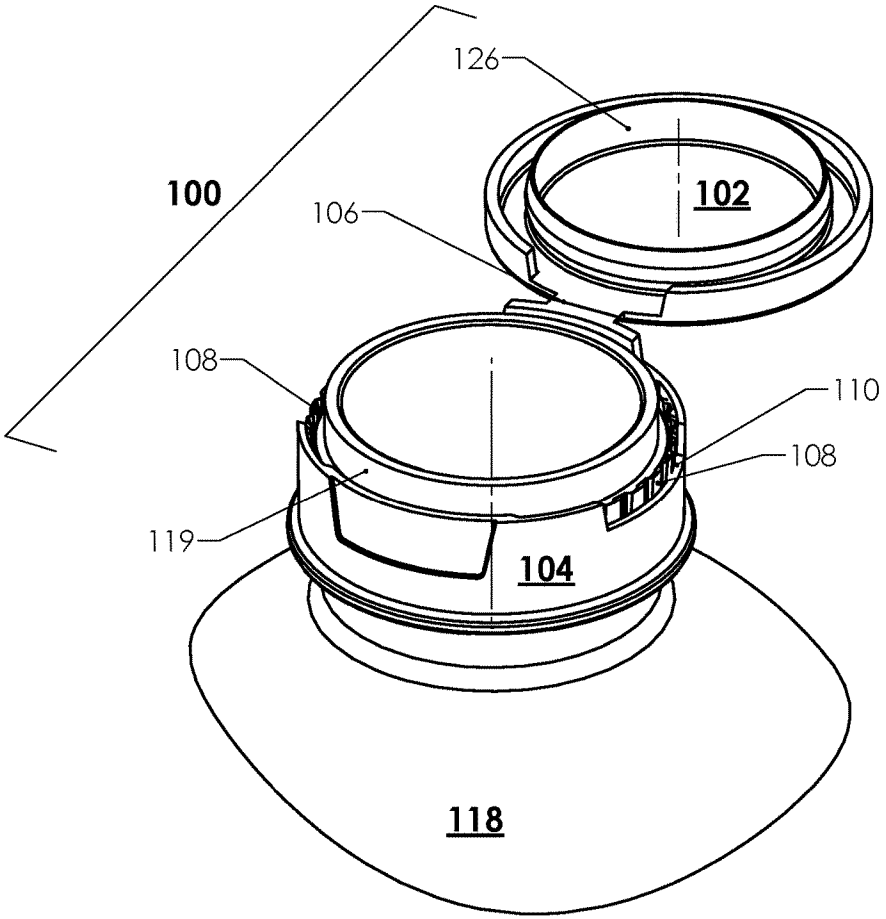
FIG. 6 is a diagram illustrating the tamper-evident flip-top closure in an open state on the neck of the container, according to an embodiment of the present invention.

Referring now to FIG. 6, a diagram illustrates the tamper-evident flip-top closure in an open position on the neck of the container, according to an embodiment of the present invention. FIG. 6 depicts the lid 102 opened and the tamper evidence tabs 108 ruptured and dropped lower between the base 104 and the neck finish 118.

Figure 7A:
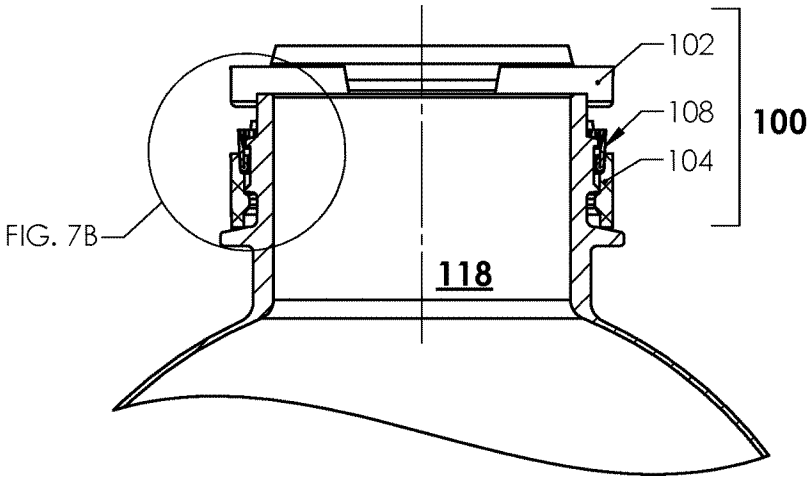
FIGS. 7A and 7B are diagrams illustrating the flip-top closure in an open state with the tamper-evidence tabs broken and separated from the lid, according to an embodiment of the present invention.
Figure 7B:
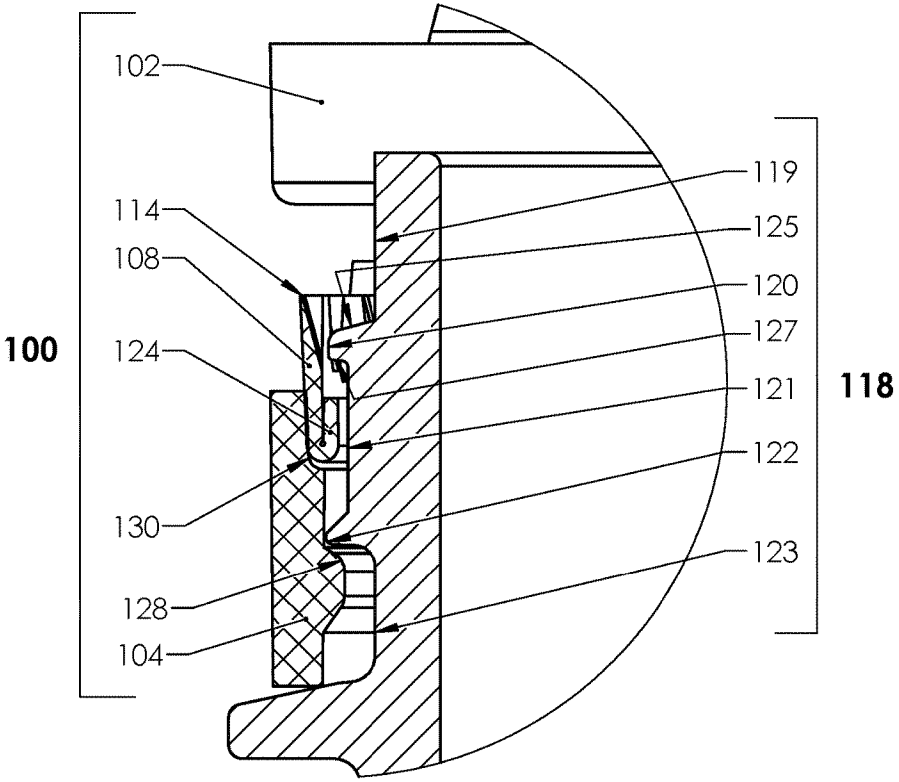

FIGS. 7A and 7B are diagrams illustrating the flip-top closure in an open state with the tamper-evidence tabs broken and separated from the lid, according to an embodiment of the present invention. The tamper-evidence tabs 108 remain disposed between the interior walls of the undercut areas 130 of the base 104, the lower surface 127 of the upper ring 120 of the neck finish 118, and the portion 121 of neck finish 118 between the upper ring 120 and the lower ring 122. However, the tamper-evidence tabs 108 drop down and away from the lower surface 127 of the upper ring 120 of the neck finish 118. The gap that is created by this drop of the tamper-evidence tabs 108 is able to be viewed through the recessed areas 110, even when the lid 102 is reclosed over the base 104, and visually indicates tampering with the sealed package.

Additionally, the tamper-evidence tabs 108 drop further below a top of the neck finish 118, ensuring that a consumer does not contact the edge of the tamper-evidence tabs 108.

FIGS. 8A-8I are cross-sectional diagrams illustrating a tool for molding and de-molding the flip-top closure of FIG. 1, according to an embodiment of the present invention.

Figure 8A:
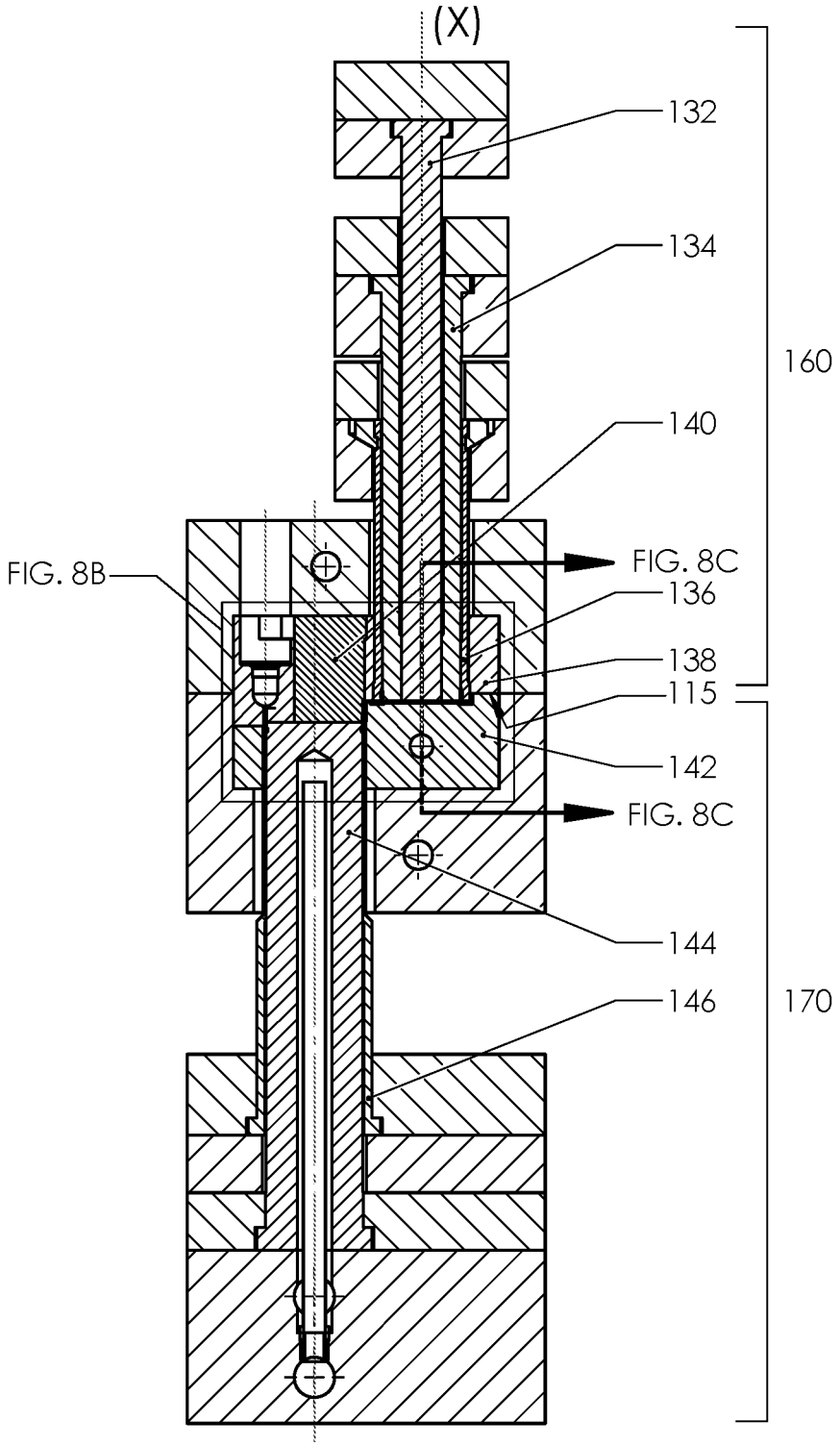
FIGS. 8A-8I are a series of cross-sectional diagrams illustrating a tool for molding and de-molding the flip-top closure of FIG. 1, according to an embodiment of the present invention.

Referring to FIG. 8A, an injection molding apparatus for the closure 100 includes a mold stack including a first mold half 160 and a second mold half 170.

The first mold half 160 includes an upper mold cavity 138, an upper mold cavity insert 140, an upper cavity core pin 132, an upper cavity outer core pin 134, and an upper mold cavity sleeve 136. The first mold half 160 is stationary during the process of molding and ejection of the molded article. However, components inside the first mold half 160 may have a degree of freedom to move relatively within the first mold half 160.

The second mold half 170 includes a lower mold cavity 142, a lower core 144, and a lower mold cavity sleeve 146.

Figure 8B:
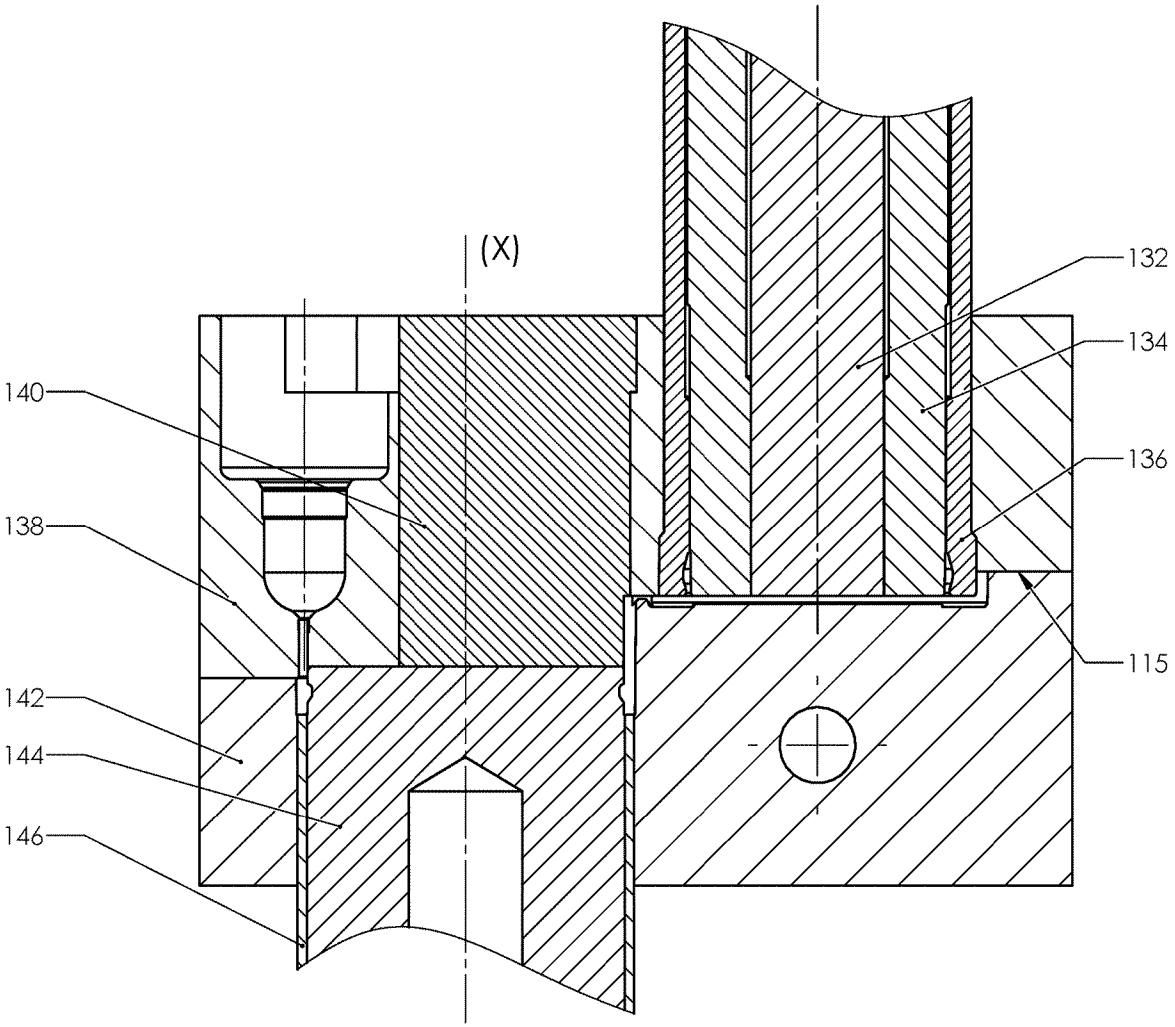
Figure 8C:
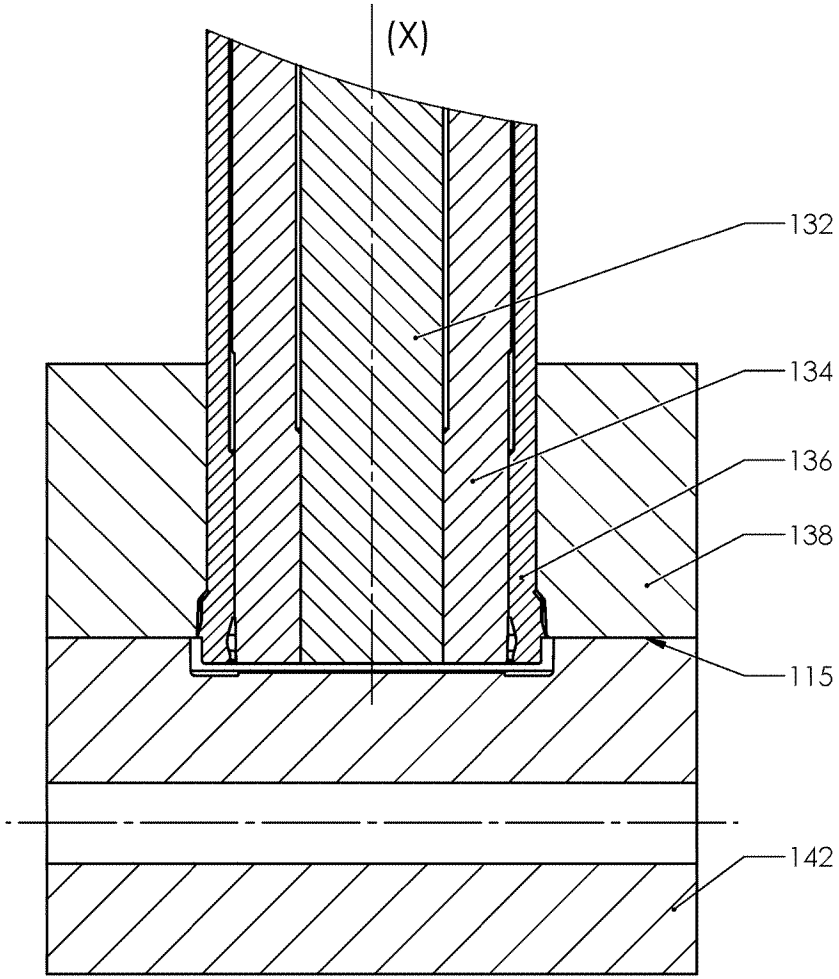

As shown in greater detail with reference to FIGS. 8B and 8C, all mold components, with the exception of the upper mold cavity 138 and the lower mold cavity 142, are rotational components with a line of action coinciding with the direction of a mold halves stroke axis X.

Figure 8D:
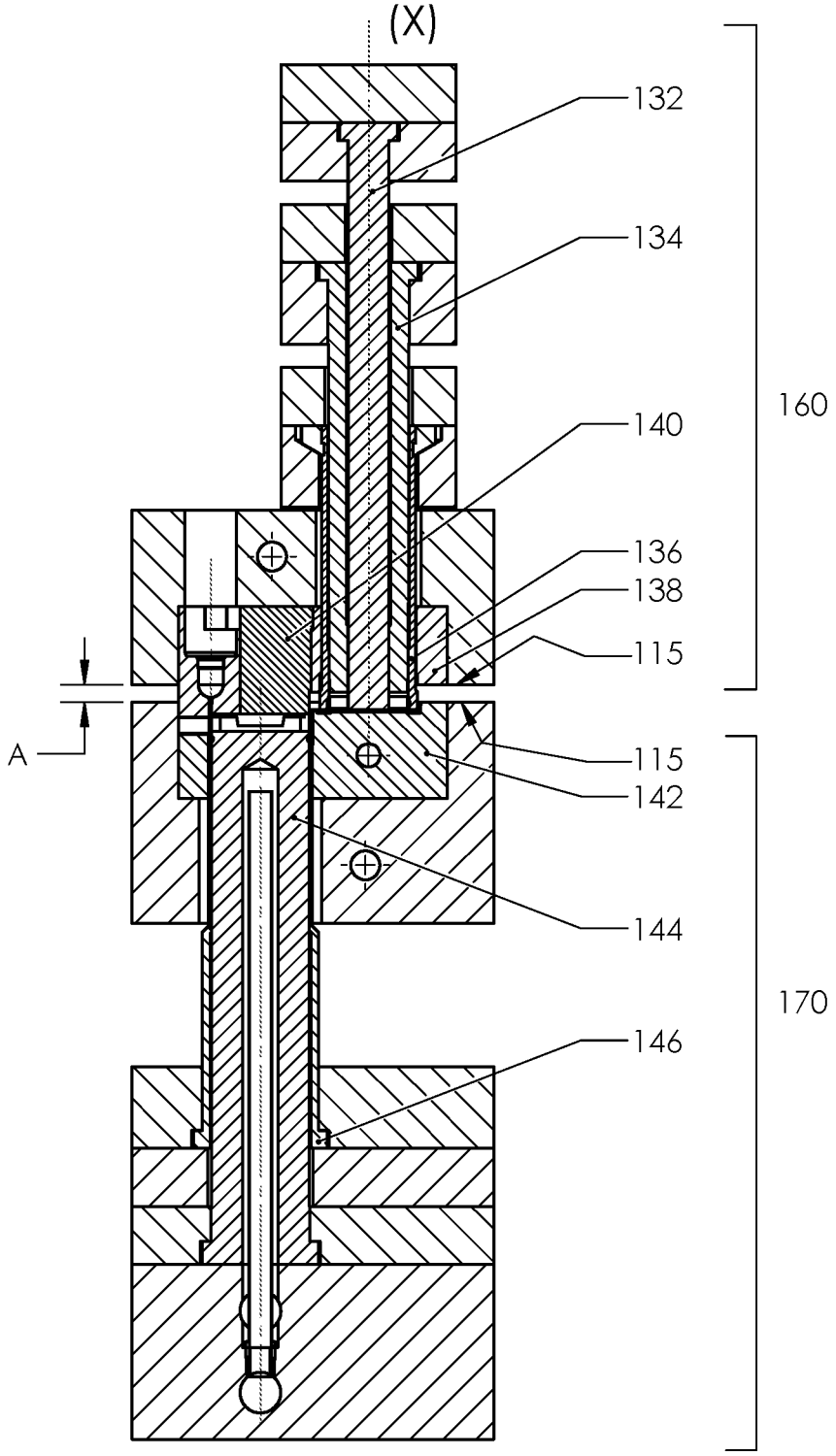

FIG. 8D illustrates a first stage of mold opening, in which the second mold half 170 is separated from the first mold half 160 by a distance "A". Simultaneously, the upper mold cavity sleeve 136 and the upper mold cavity core pin 132 are moved relative to the upper mold cavity 138, inside the upper mold half 160, following the second mold half 170 for the distance "A". At the end of the motion, the upper mold cavity sleeve 136 reaches the limits of its relative movement.

Distance "A" should always be greater than an overall height of the tamper-evidence tabs 108, as illustrated in FIG. 1.

As the second mold half 170 moves away from the first mold half 160, all of the components inside the second mold half 170 retain their relative position.

The retaining of the relative position of the components inside the second mold half 170 and the relative movement of upper mold cavity sleeve 136 and upper mold cavity core pin 132, following the movement of the second mold half 170, ensures that the closure 100 always stays in second mold half 170 as molded.

As shown in FIGS. 1 and 8C, internal surfaces of the closure 100 are formed by the upper mold cavity sleeve 136 and external surfaces of the closure 100 are formed by the upper mold cavity 138.

Figure 8E:
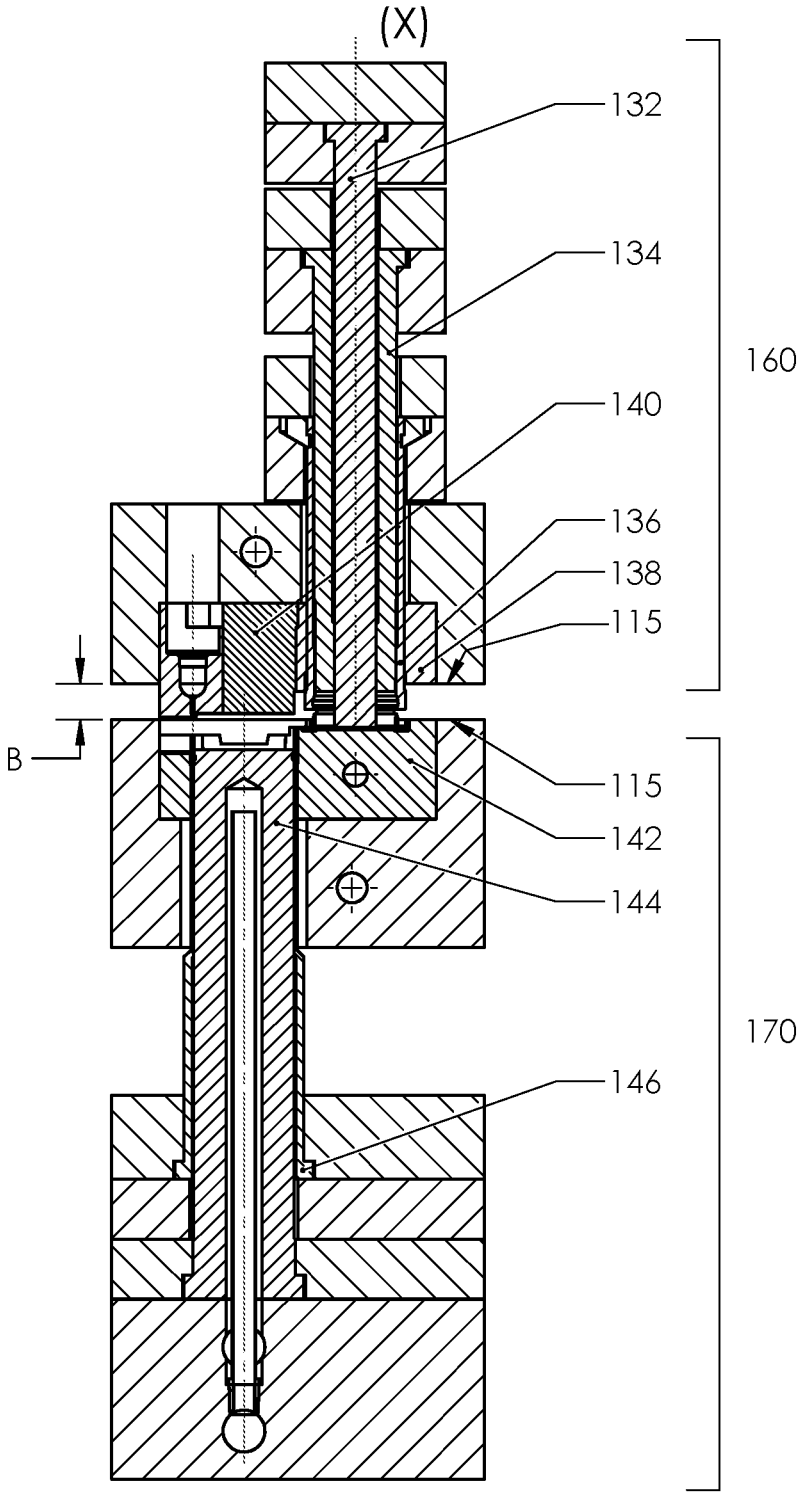

As shown in FIG. 8E, the second mold half 170 separates from the first mold half 160 by a greater distance "B". All of the components of the second mold half 170 retain their relative position. The upper mold cavity core pin 132 follows the second mold half 170 for the distance "B", but the upper mold cavity sleeve 136 maintains a same relative position to the upper mold cavity 138, as in FIG. 8D.

The relative motion between the upper mold cavity core pin 132 and the upper mold cavity sleeve 136 ensures complete separation of all surfaces of the tamper-evidence tabs 108 of the closure 100 from corresponding mold components without rupturing the tamper-evidence tabs 108 from the lid 102 of the closure 100.

Figure 8F:
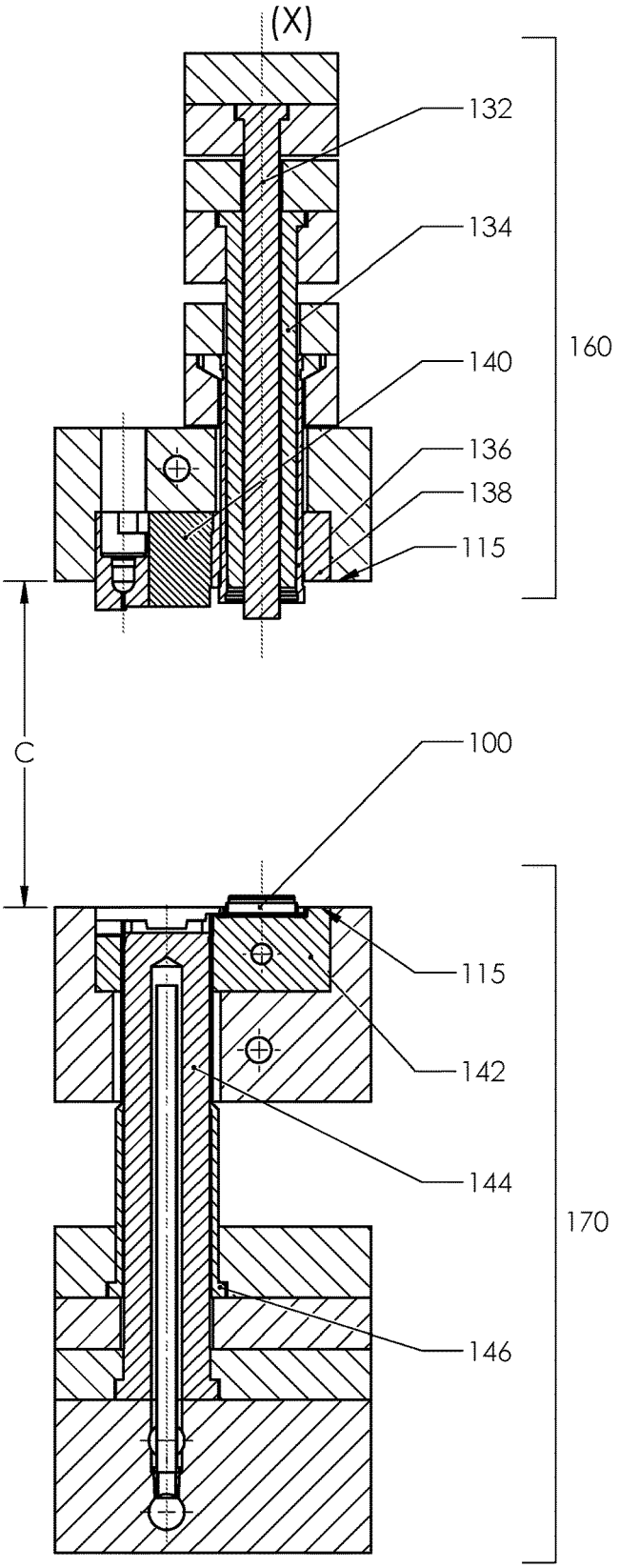

In FIG. 8F, the second mold half 170 is separated from the first mold half 160 by a greater distance "C". All internal components of the first mold half 160 and the second mold half 170 retain their relative positions as in FIG. 8E.

Figure 8G:
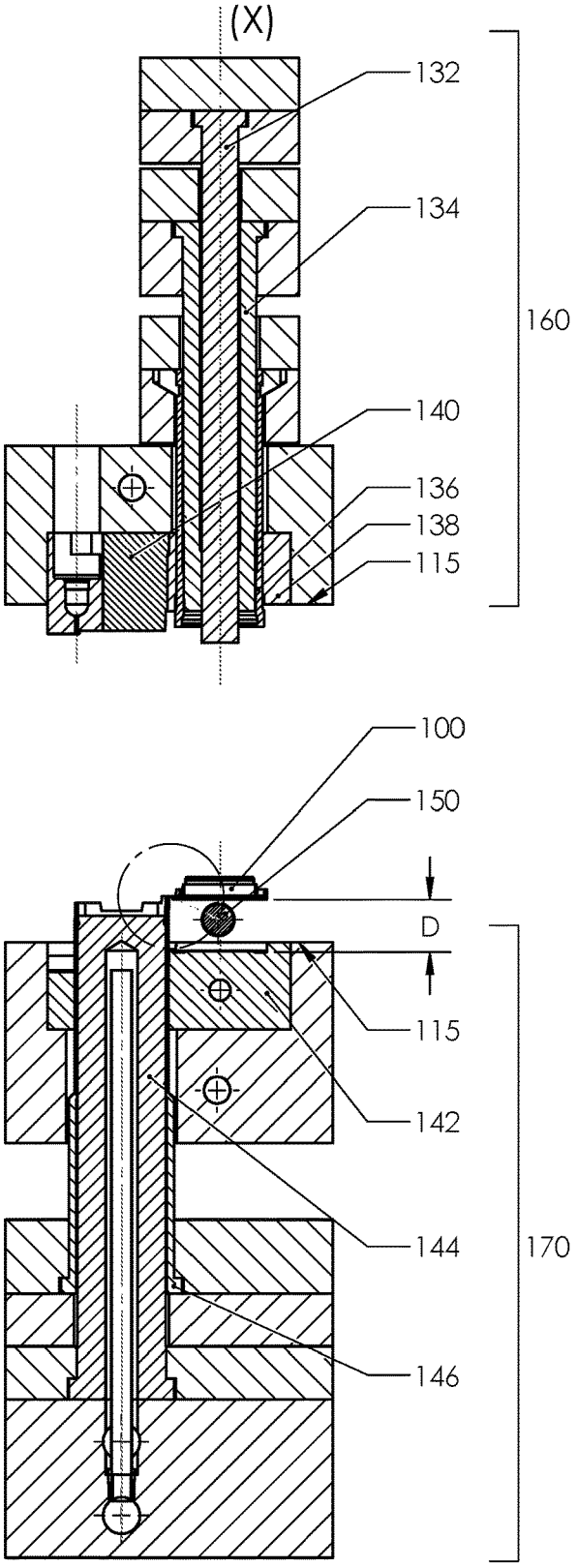

In FIG. 8G, both the first mold half 160 and the second mold half 170 keep their relative position at distance "C".

Inside the second mold half 170, the lower core 144 and the lower mold cavity sleeve 146 move relative to the lower mold cavity 142 by a distance "D" in a direction toward the first mold half 160. By moving the distance "D", the base 104 of the closure 100 is completely removed out from the lower mold cavity 142, and the lid 102 is disposed above a parting line 115.

In FIG. 8G, a rod 150 of an in-mold closing apparatus is positioned under the lid 102. The closure 100 is held in place around the lower core 144 and on top of the lower mold cavity sleeve 146.

Figure 8H:
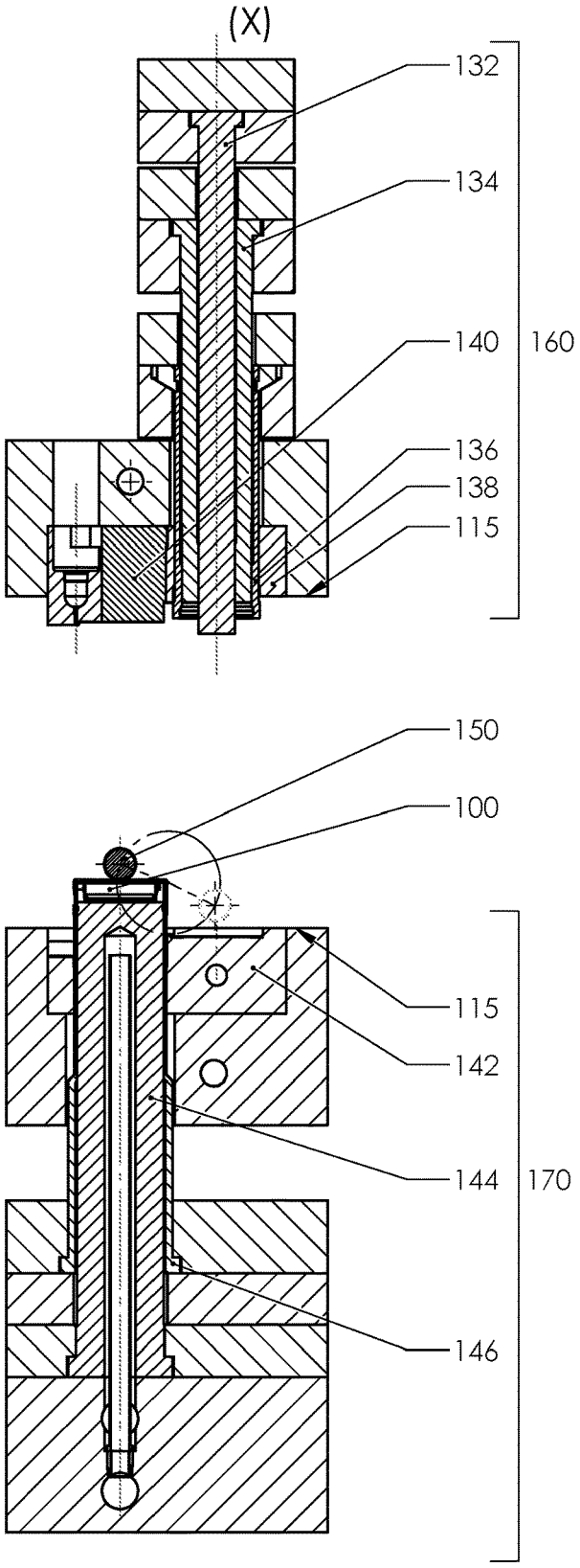

In FIG. 8H, the rod 150 of the in-mold closing apparatus has completed its stroke of closing the lid 102 over the base 104 of closure 100.

The rod 150 is moved away from the closure 100 to allow for ejection.

Figure 8I:
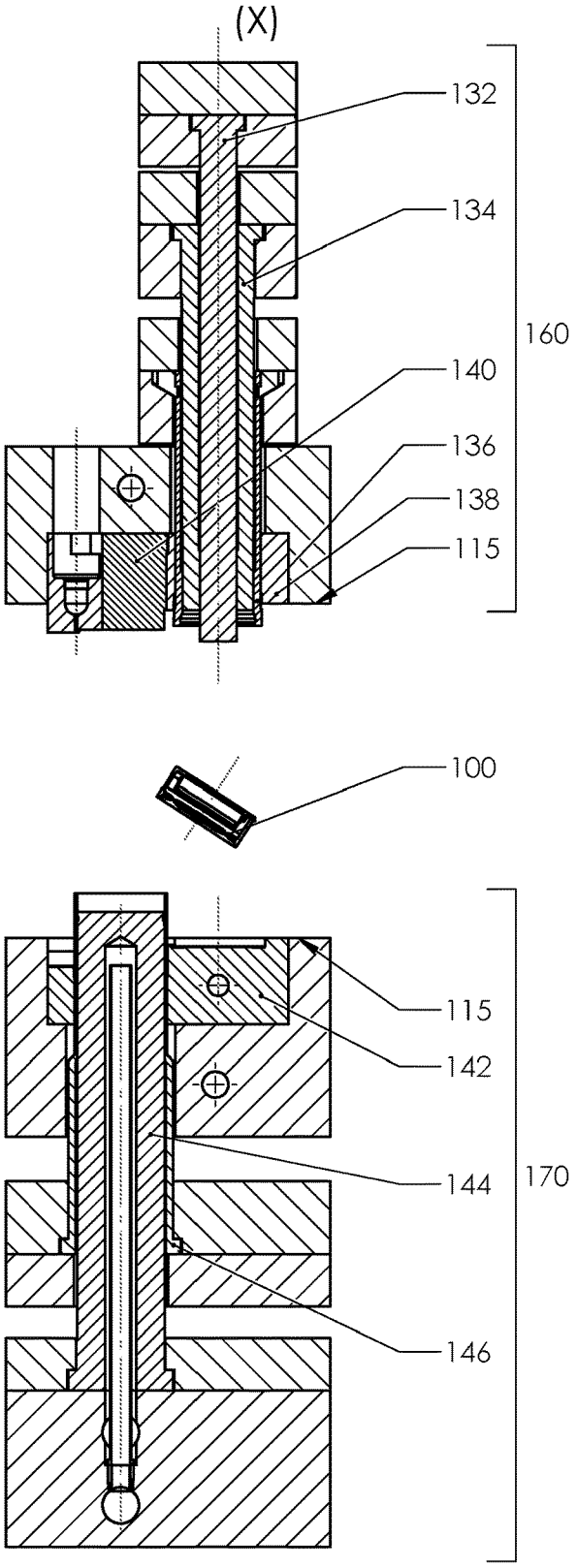

In FIG. 8I, the closure 100 is shown ejected by a relative motion of the lower mold cavity sleeve 146 towards the first mold half 160. The closure 100 is in a closed state, as shown in FIG. 2A, ready to be assembled with a container.

Figure 9A:
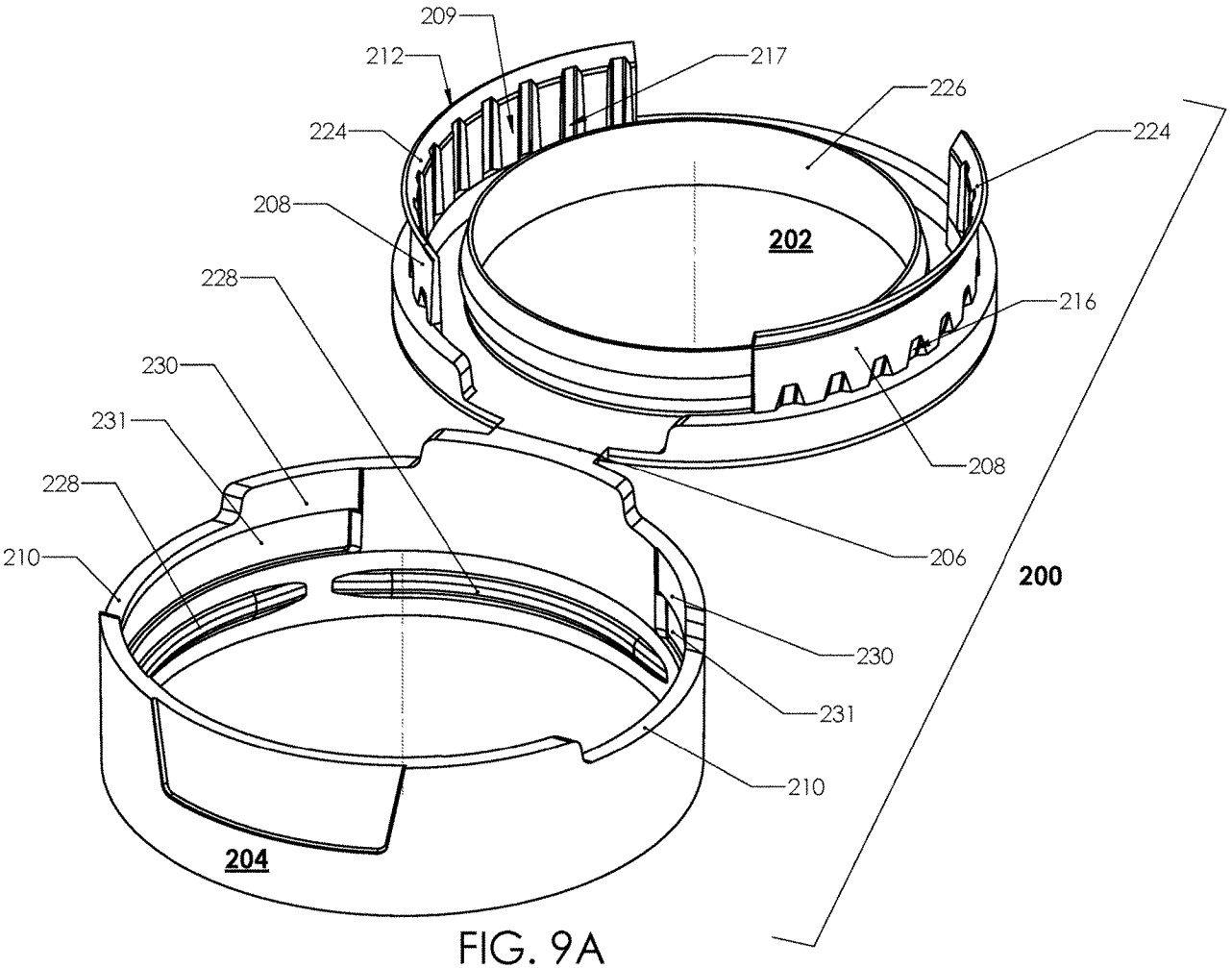
FIG. 9A is a diagram illustrating an isometric view of a tamper-evident flip-top closure in an open state, according to another embodiment of the present invention.
Figure 11:
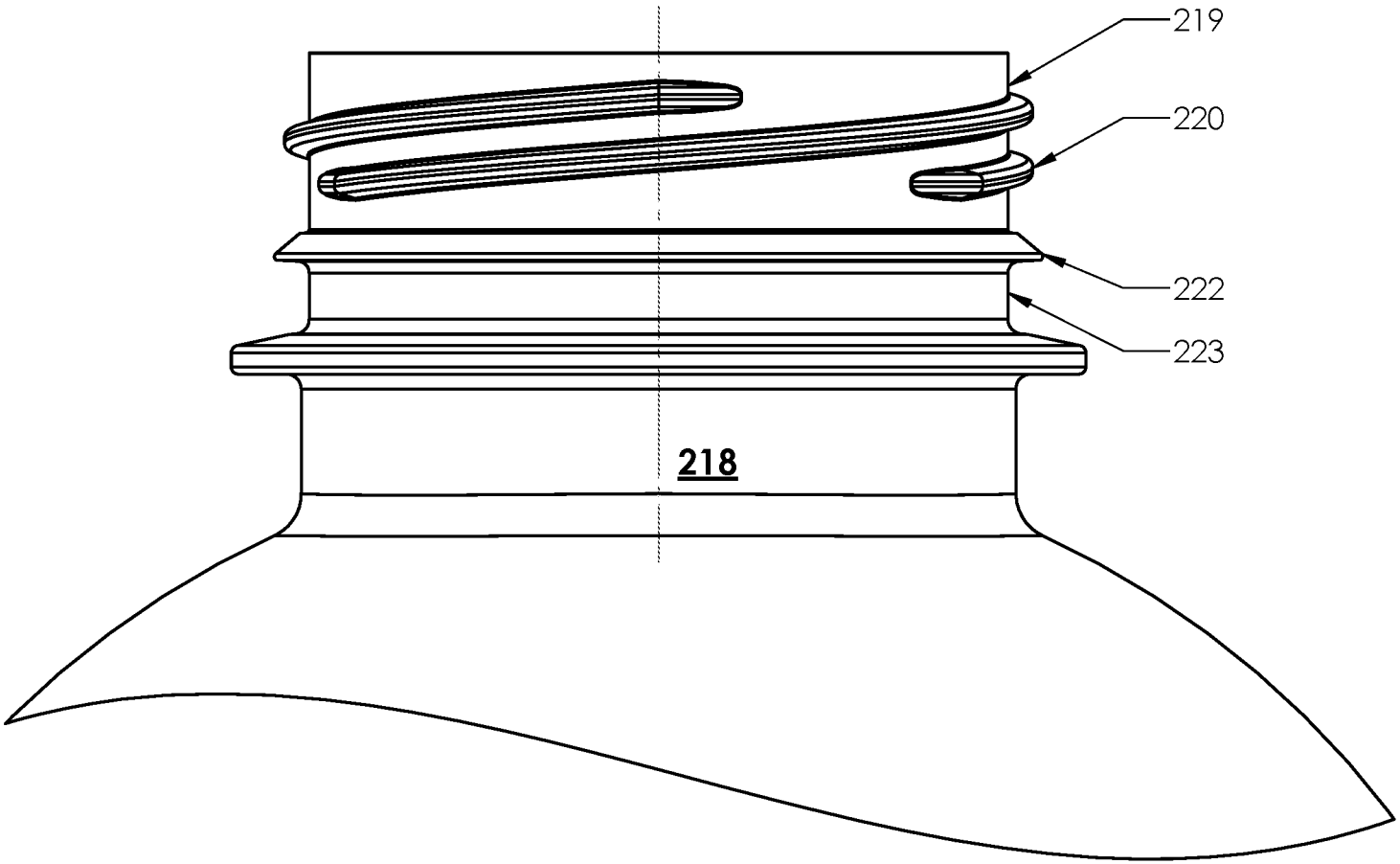
FIG. 11 is a diagram illustrating a front view of a neck of a container to which the closure of FIG. 9A is assembled to form a sealed package.

Referring now to FIG. 9A, a diagram illustrates an isometric view of a tamper-evident flip-top closure in an open state, according to another embodiment of the present invention. A closure 200 includes a base 204, a lid 202, and two tamper-evidence tabs 208. The closure 200 is designed to be assembled on a container having a neck finish as shown in FIG. 11.

Unlike the closure 100 of FIG. 1, free ends of the tamper-evidence tabs 208, or lip portions 224, are angled outwardly relative to the base 204. This design creates the same locking mechanism between the tamper-evidence tabs 208, the base 204, and a neck finish 218 of the container, even though the neck finish 218 of FIG. 11 differs from that of FIG. 3.

Additionally, the closure 200 differs from the closure 100 of FIG. 1 in that the closure 200 includes a first undercut area 230 and a second undercut area 231, which serve as receptacles for the tamper evidence tabs 208. Further, external cut-outs 216 of FIG. 2 have a shape similar to that of internal cut-outs 117 of FIG. 1, and internal cut-outs 217 of FIG. 2 have a shape similar to that of external cut-outs 116 of FIG. 1. The design of the external cut-outs 216 and the internal cut-outs 217 of surface 209 is changed due to the outwardly angled lip portions 224.

A living hinge 206, recessed areas 210, a plug seal 226, and a retaining ring 228 are substantially identical to corresponding elements 106, 110, 126, and 128 of FIG. 1.

Figure 9B:
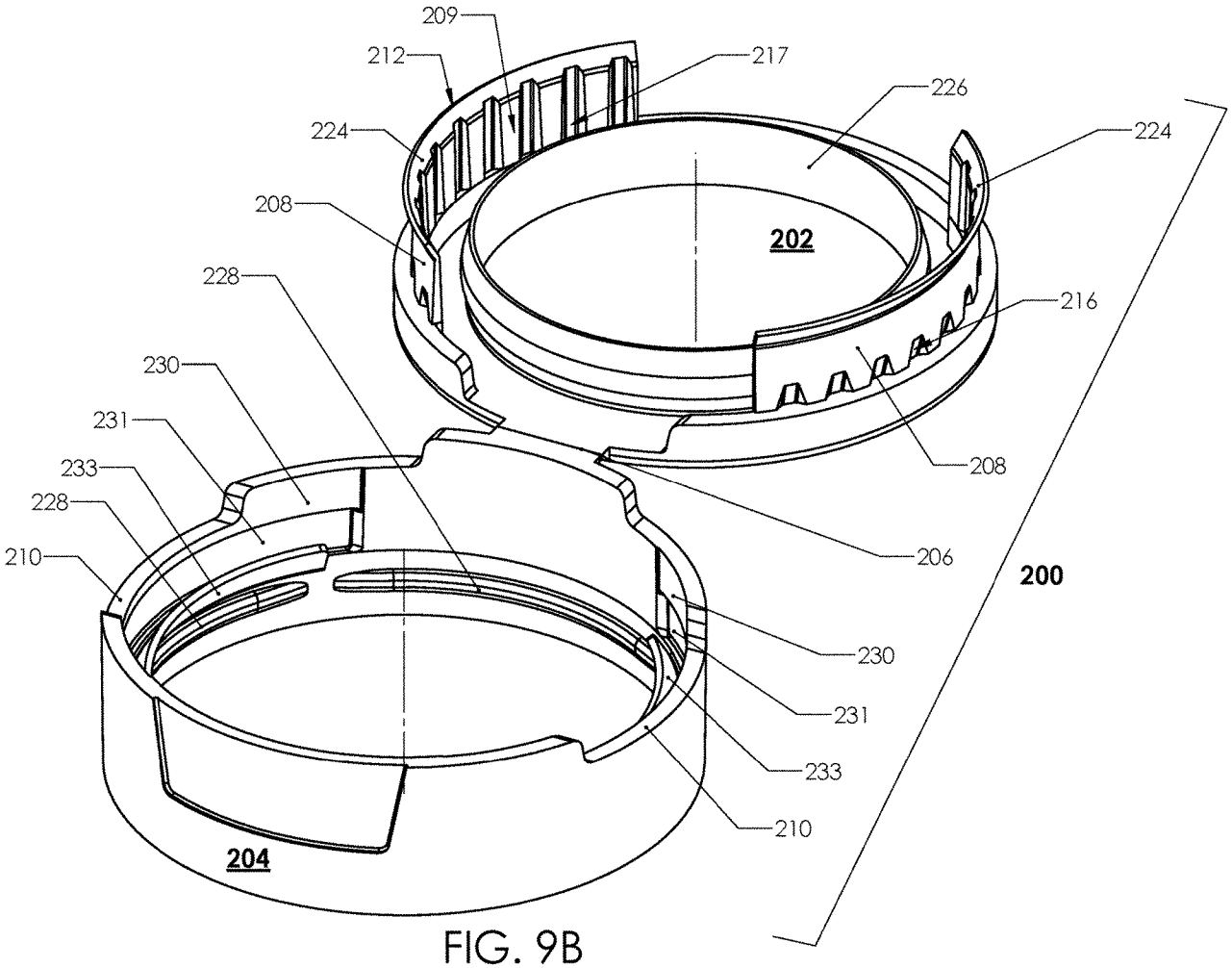
FIG. 9B is a diagram illustrating an isometric view of a tamper-evident flip-top closure in an open state, according to another embodiment of the present invention.

FIG. 9B is a diagram an isometric view of a tamper-evident flip-top closure in an open state, according to another embodiment of the present invention. The embodiment of FIG. 9B differs from that of FIG. 9A in that it includes flanges 233 on the inner surface of the base 204. The number of flanges 233 at the inner surface of the base is equal to the number of tamper-evidence tabs 208. The flanges 233 are located above retaining ring 228 and below undercut area 231 of the inner surface of the base 204. The geometry of the flanges 233 is upwardly angled to facilitate interference with the neck finish 218 during assembly of the closure to a container and to ensure positive folding over of the tamper-evidence tabs 208.

Figure 10B:
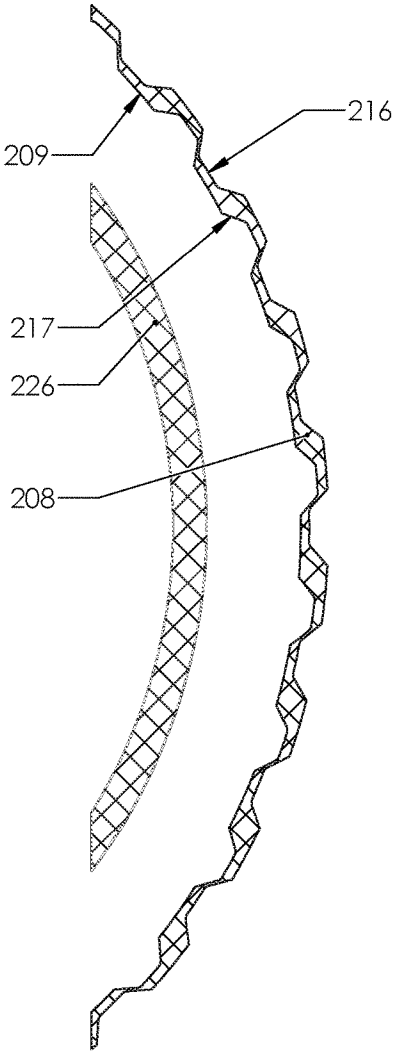
FIG. 10B is a diagram illustrating a rupture line of the tamper-evidence tabs of FIG. 10A, according to another embodiment of the present invention.
Figure 10A:
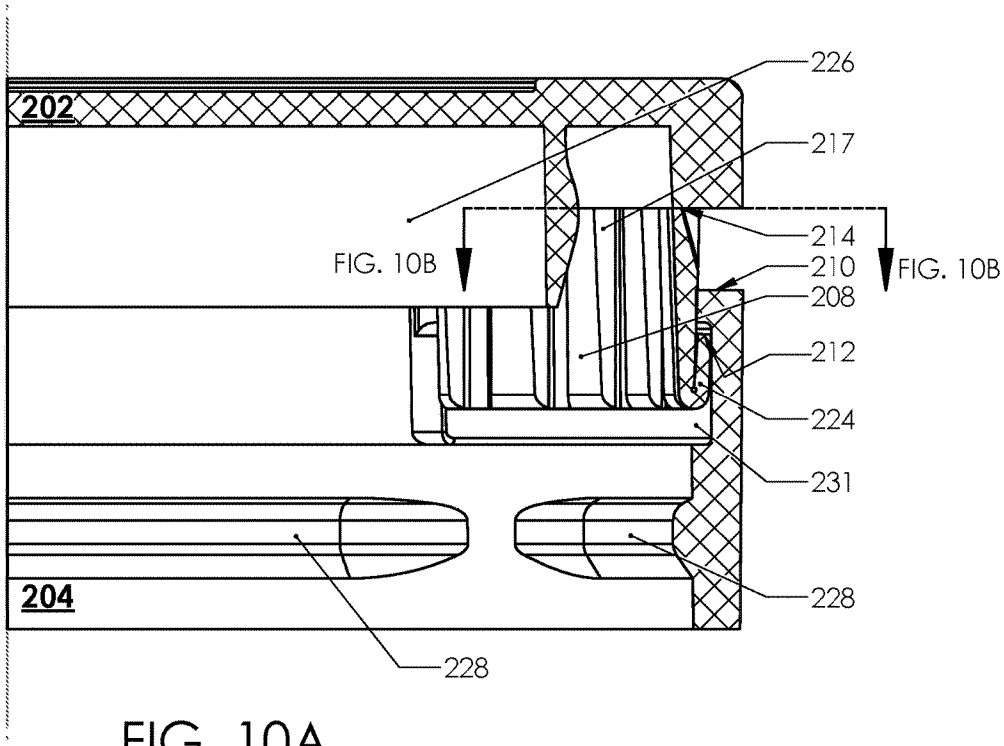
FIG. 10A is a diagram illustrating a partial view in cross-section of the tamper-evident flip-top closure of FIG. 9A, in a closed state, according to another embodiment of the present invention.

FIG. 10A is a diagram illustrating a partial view in cross-section of the tamper-evident flip-top closure of FIG. 9A, in closed state, according to another embodiment of the present invention. The cross-section shows the relative position of the main elements of the closure 200 before being assembled on the container.

When the lid 202 is closed over the base 204 of the closure 200, the external sides of the tamper-evidence tabs 208 are in contact with and supported by surfaces of the first and second undercut areas 230 and 231 of the base 204. The lip portions 224 are folded outwardly back onto the tamper-evidence tabs 208 in the second undercut area 231, and locked below the first undercut area 230, as will be described in greater detail below with reference to FIGS. 12A-12D.

FIG. 10B is a diagram illustrating a rupture line of the tamper-evidence tabs of FIG. 10A, according to another embodiment of the present invention. The rupture line of FIG. 10A is substantially identical to the rupture line illustrated in FIG. 2B.

Figure 10C:
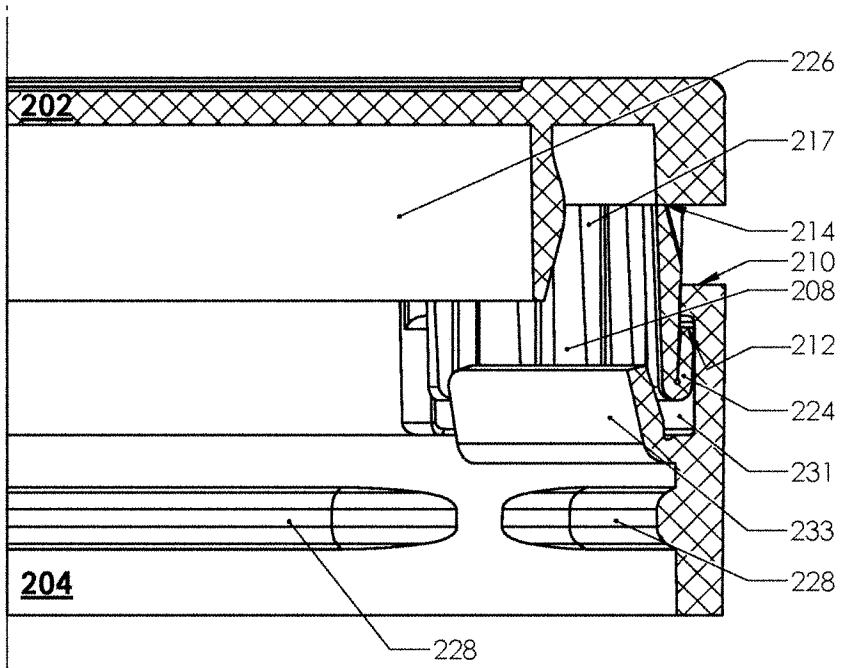
FIG. 10C is a diagram illustrating a partial view in cross-section of the tamper-evident flip-top closure of FIG. 9B, in a closed state, according to another embodiment of the present invention.

FIG. 10C is a diagram illustrating a partial view in cross-section of the tamper-evident flip-top closure of FIG. 9B, in a closed state, according to another embodiment of the present invention. As shown, the flange 233 interferes with the neck finish 218 during assembly of the closure to a container and ensures positive folding over of the tamper-evidence tab 208.

FIG. 11 is a diagram illustrating a neck finish of a container with which a closure can be assembled to form a sealed package. A neck finish 218 corresponds to an eco-shape bottle neck finish. The neck finish 218 features a three-lead thread 220 and a lower ring 222. An upper portion is disposed above the three-lead thread 220, and a lower portion 223 is disposed below the lower ring 222.

FIGS. 12A-12D are diagrams illustrating application and locking of the closure to the neck of a container, according to another embodiment of the present invention.

Figure 12B:
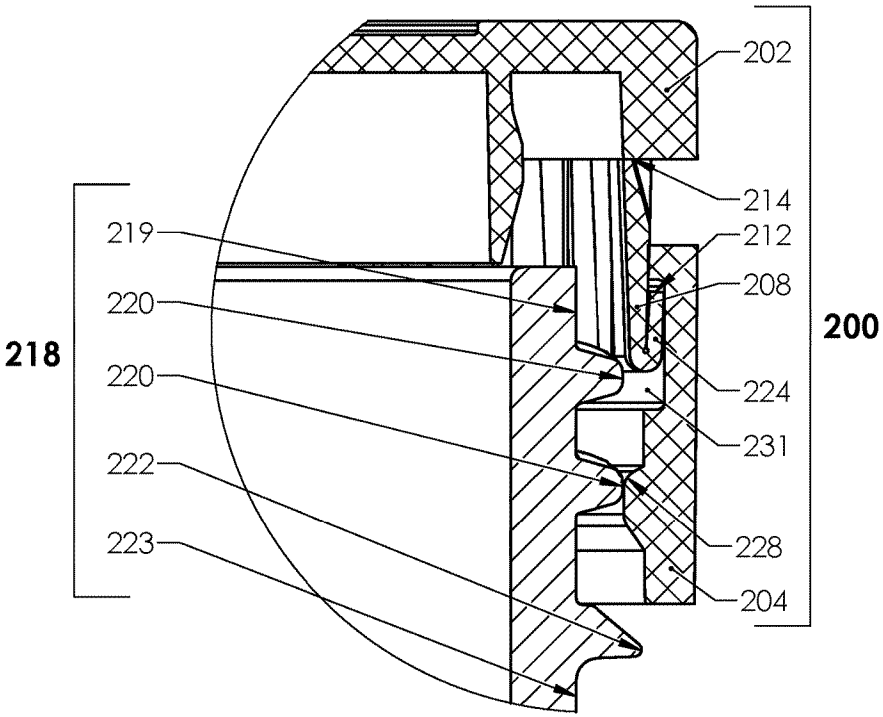
FIGS. 12A-12D are a series of diagrams illustrating application and locking of the closure of FIG. 9A to the neck of a container, according to another embodiment of the present invention.
Figure 12A:
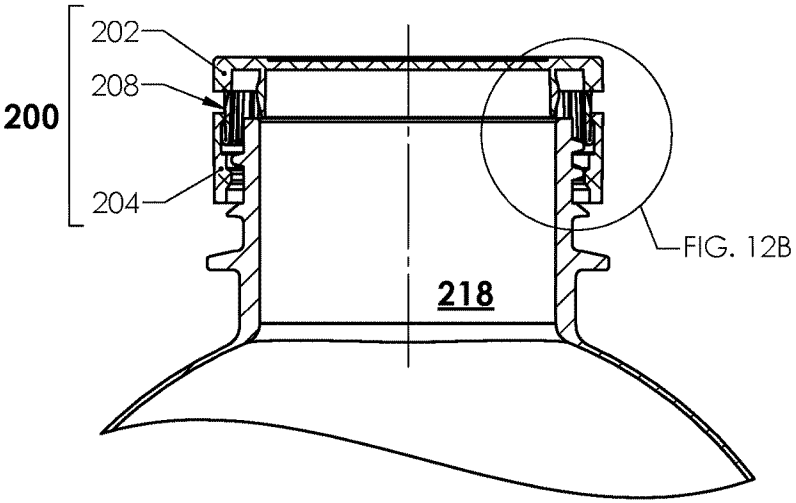

Referring to FIGS. 12A and 12B, the closure 200 is assembled to the neck finish 218 of the container. The lip portions 224 fold outwardly during the process of closing the lid 202 over the base 204, and are disposed in the second undercut area 231 of the base 204. The retaining ring 228 of the base 204 is disposed adjacent to the three-lead thread 220 of the neck finish 218, and above the lower ring 222 of the neck finish 218.

Figure 12D:
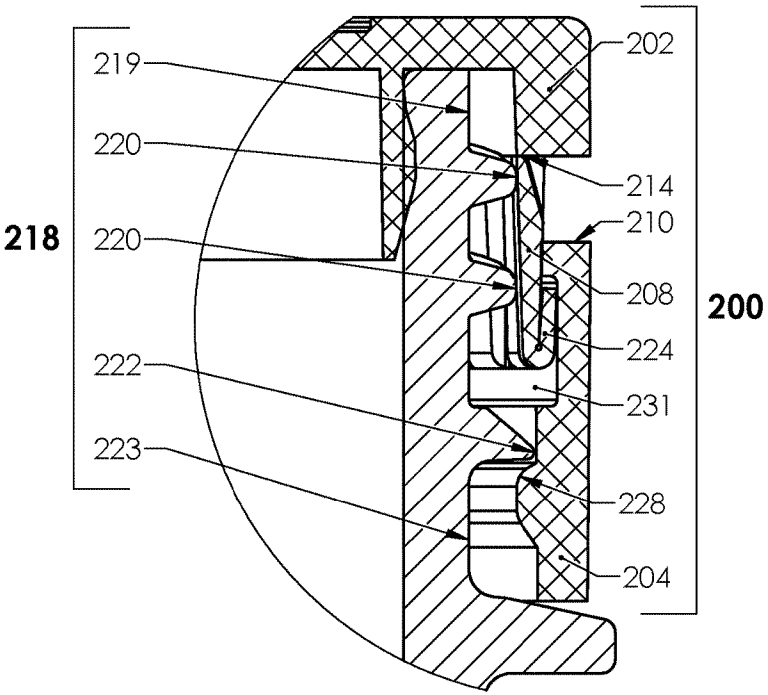
Figure 12C:
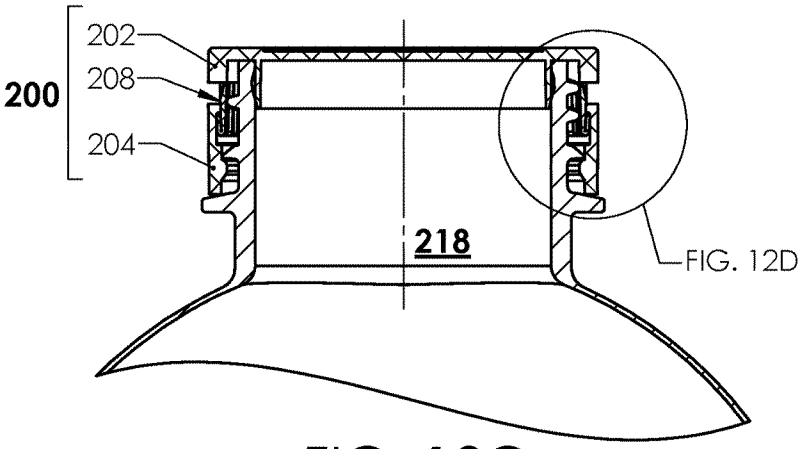

In FIGS. 12C and 12D, the closure 200 of FIG. 9A is fully assembled over the neck finish 218 of the container. The retaining ring 228 of the base 204 of the closure is snapped under the lower ring 222 of the neck finish 218. The lip portions 224 of the tamper-evidence tabs 208 are locked into place, in a folded position, firmly between the walls of the first and second undercut areas 230 and 231 of the base 204, and individual leads of the three-lead thread 220 of the neck finish 218.

Figure 12E:
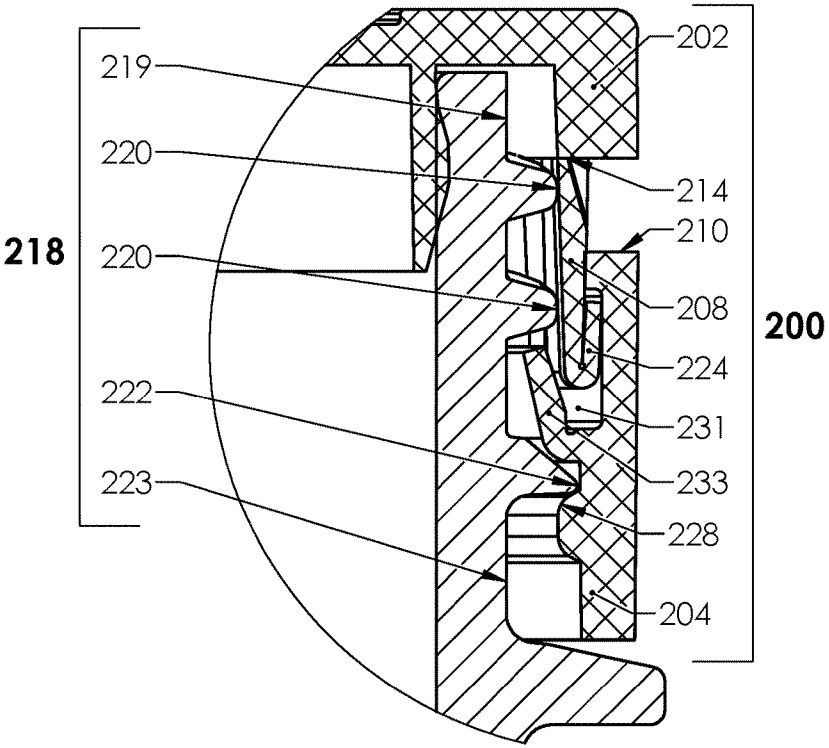
FIG. 12E is a diagram illustrating application and locking of the closure of FIG. 9B to the neck of a container, according to another embodiment of the present invention.

Referring to FIG. 12E, the closure 200 of FIG. 9B is fully assembled over the neck finish 218 of the container. The lip portions 224 of the tamper-evidence tabs 208 are locked into place in a folded position, firmly between the walls of the first and second undercut areas 230 and 231 of the base, and individual leads of the three-lead thread 220 of the neck finish 218. The flanges 233 provide complimentary support to the tamper-evidence tabs 208.

The isometric view of the tamper-evident flip-top closure in a closed and assembled state is shown in FIG. 5. As illustrated in FIG. 5, the recessed areas of the base allow for a visual check to determine whether a seal between the lid and the container was tampered with. Additionally, the isometric view of the tamper-evident flip-top closure in an open state is shown in FIG. 6.

Figure 13B:
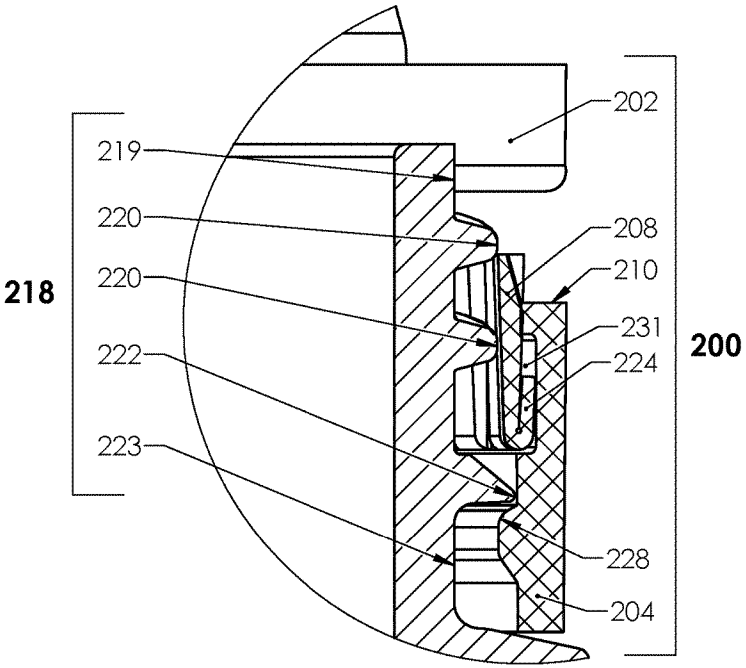
FIGS. 13A and 13B are diagrams illustrating the flip-top closure in an open state with the tamper-evidence tabs broken and separated from the lid, according to another embodiment of the present invention.
Figure 13A:
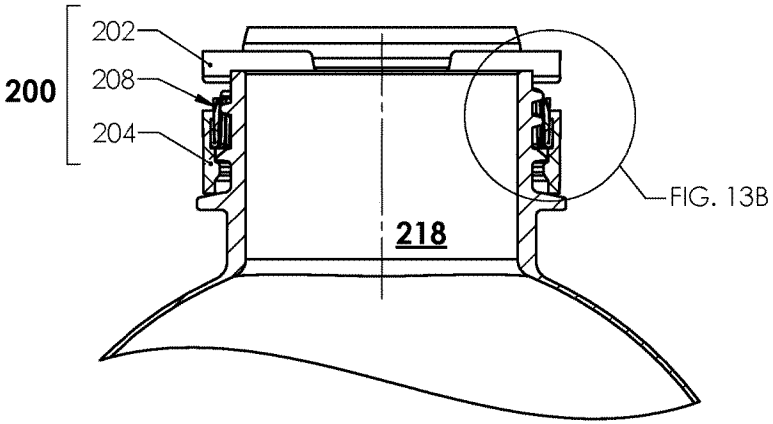

FIGS. 13A and 13B are diagrams illustrating the flip-top closure in an open state with the tamper-evidence tabs broken and separated from the lid, according to an embodiment of the present invention. The tamper-evidence tabs 208 remain disposed between the interior walls of the first and second undercut areas 230 and 231 of the base 204, and individual leads of the three-lead thread 220 of the neck finish 218. However, the tamper-evidence tabs 208 drop down and away from the lid 202. The gap that is created by this drop of the tamper-evidence tabs 208 is able to be observed through the recessed areas 210, even when the lid 202 is reclosed, and visually indicates tampering with the sealed package.

Additionally, the tamper-evidence tabs 208 drop further below a top of the neck finish 218, ensuring that a consumer does not contact the edge of the tamper-evidence tabs 208.

FIGS. 14A-14G are diagrams illustrating in cross-sections the tool for molding and de-molding the closure, according to an embodiment of the present invention.

Figure 14A:
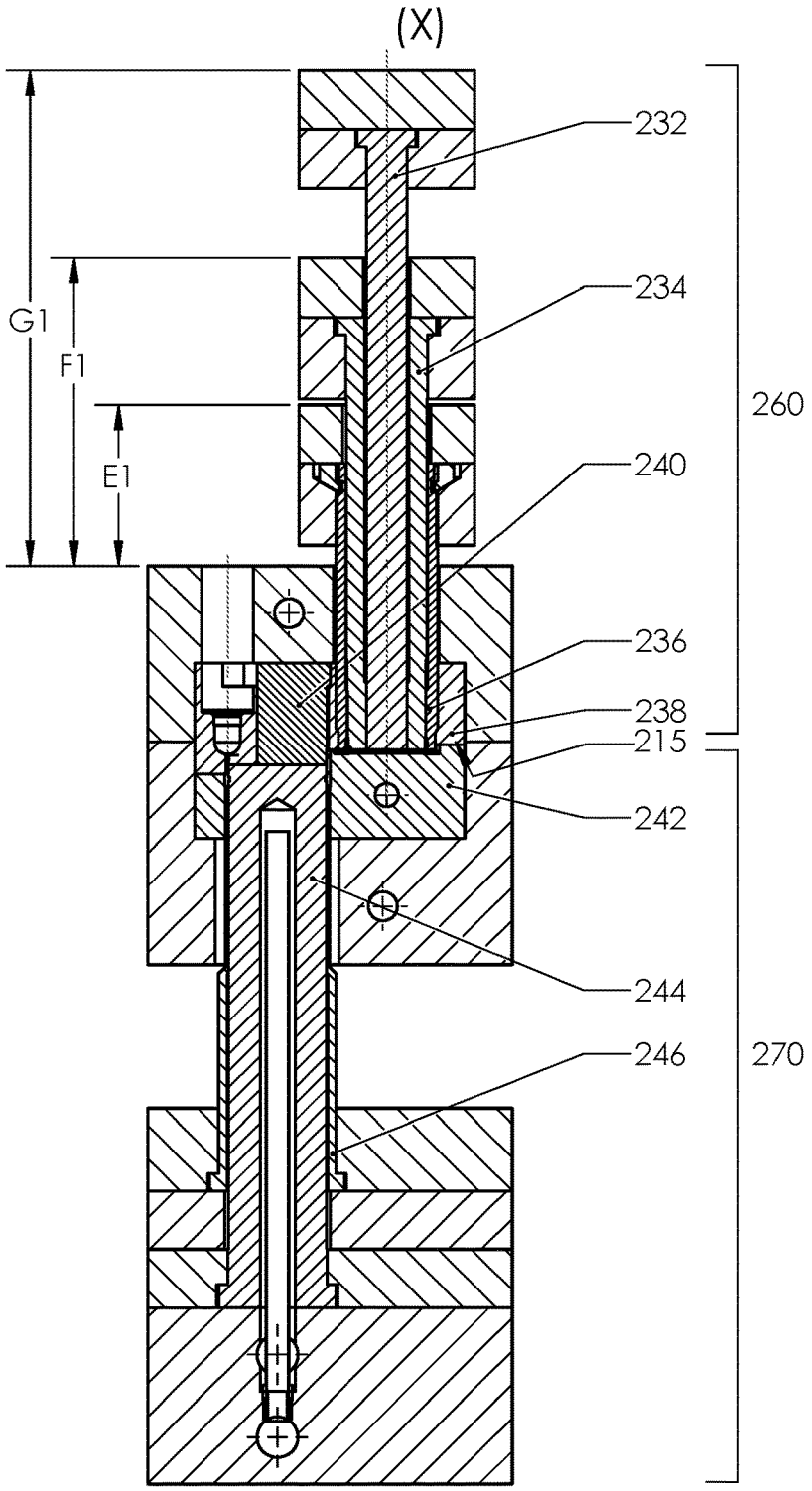
FIGS. 14A-14G are a series of cross-sectional diagrams illustrating a tool for molding and de-molding the flip-top closure of FIG. 9A, according to another embodiment of the present invention.

Referring to FIG. 14A, an injection molding apparatus for the closure 200 includes a mold stack including a first mold half 260 and a second mold half 270.

The first mold half 260 comprises a upper mold cavity 238, an upper mold cavity insert 240, an upper cavity core pin 232, an upper cavity outer core pin 234, and an upper mold cavity sleeve 236. The first mold half 260 is stationary during the process of molding and ejection of the molded article. However, components inside the first mold half 260 may have a degree of freedom to move relatively within the first mold half 260.

The second mold half 270 includes a lower mold cavity 242, a lower core 244, and a lower mold cavity sleeve 246.

All mold components, with the exception of the upper mold cavity 238 and the lower mold cavity 242 are rotational components with a line of action coinciding with the direction of a mold halves stroke axis X.

Figure 14B:
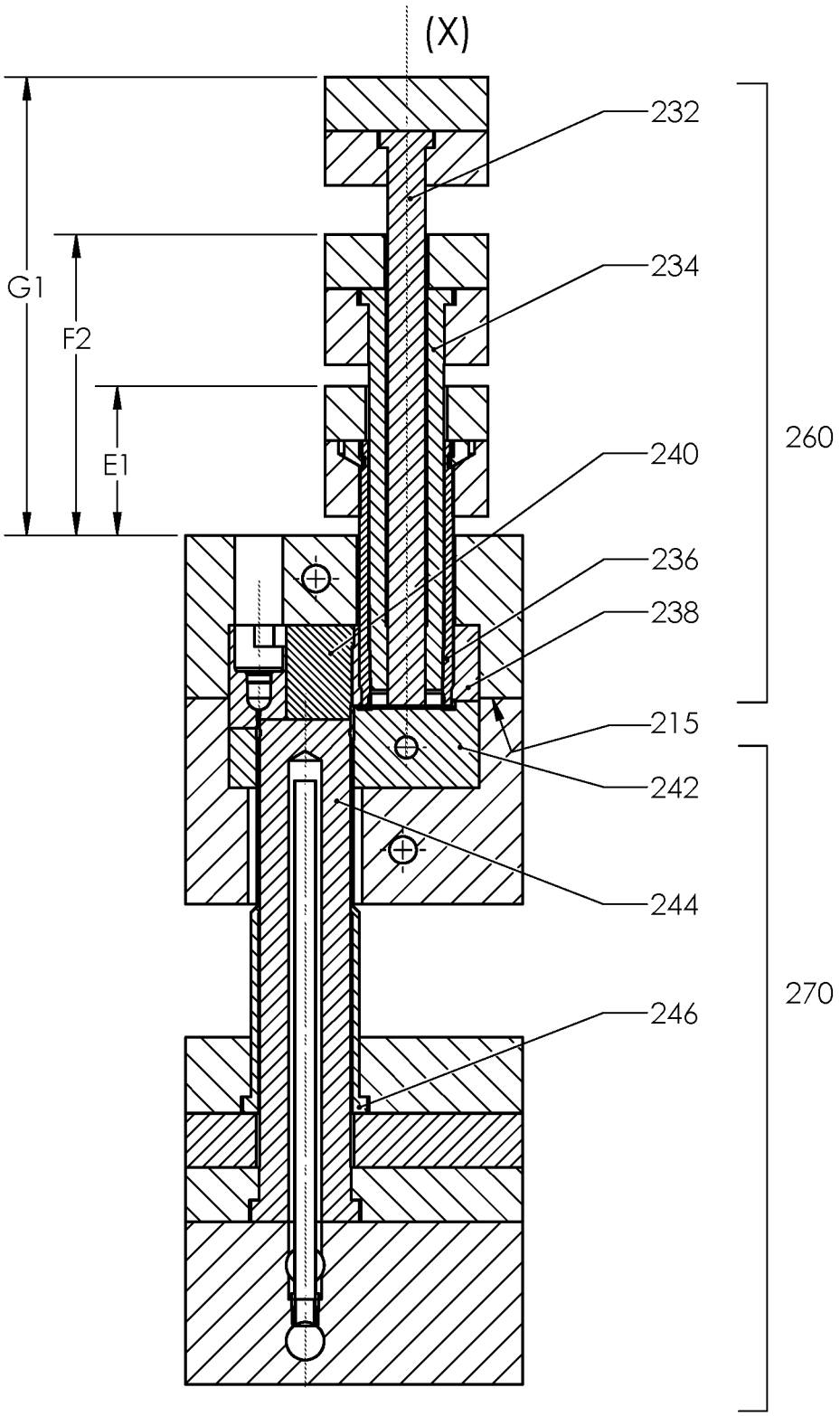

FIG. 14B illustrates a first stage of mold opening, in which the upper mold cavity outer core 234 moves from distance F1 to distance F2 relative to the rest of the components of the first mold half 260, which are following the second mold half 270. At the end of that motion the upper mold cavity outer core 234 reaches the limits of its relative movement.

The distance the upper mold cavity core 234 travels is greater than an overall height of the plug seal 226.

As the second mold half 270 moves during mold opening, all of the components inside the second mold half 270 retain their relative position.

Figure 14C:
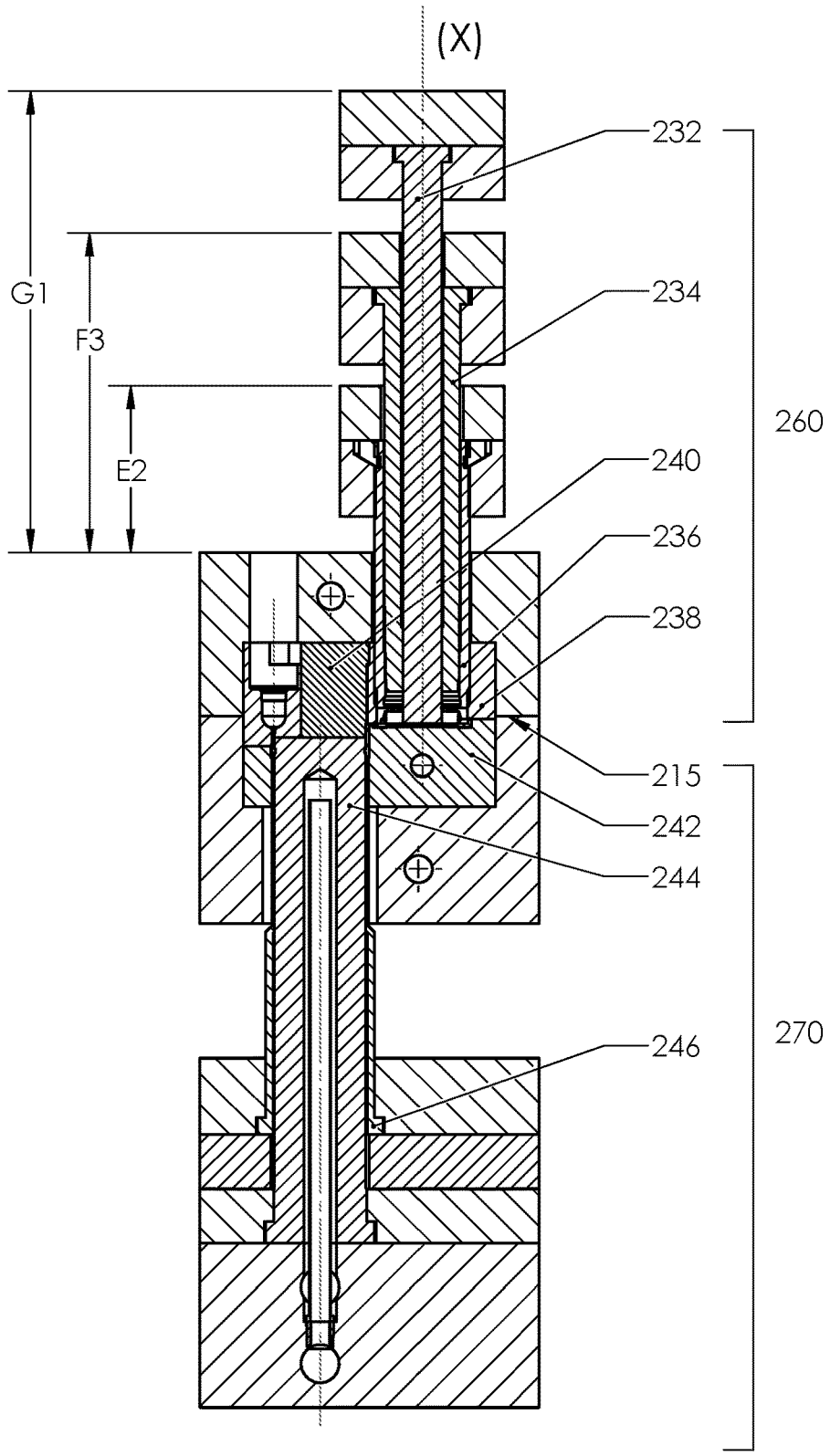

During the second stage of mold opening, as illustrated in FIG. 14C there is still no visual separation at a parting line 215. The upper mold cavity outer core 234 moves even further away from the upper mold cavity 238 to a distance F3. Simultaneously, the upper mold cavity sleeve 236 moves away from the upper mold cavity 238 from a distance E1 to a distance E2.

The relative motion of components inside of the upper mold half 260 during the first two stages of mold opening (as illustrated in FIGS. 14B and 14C) ensures that all surfaces of the lid 202 of the closure 200 are cleared from engagement with mold stack components to further facilitate closure ejection and in-mold closing.

Figure 14D:
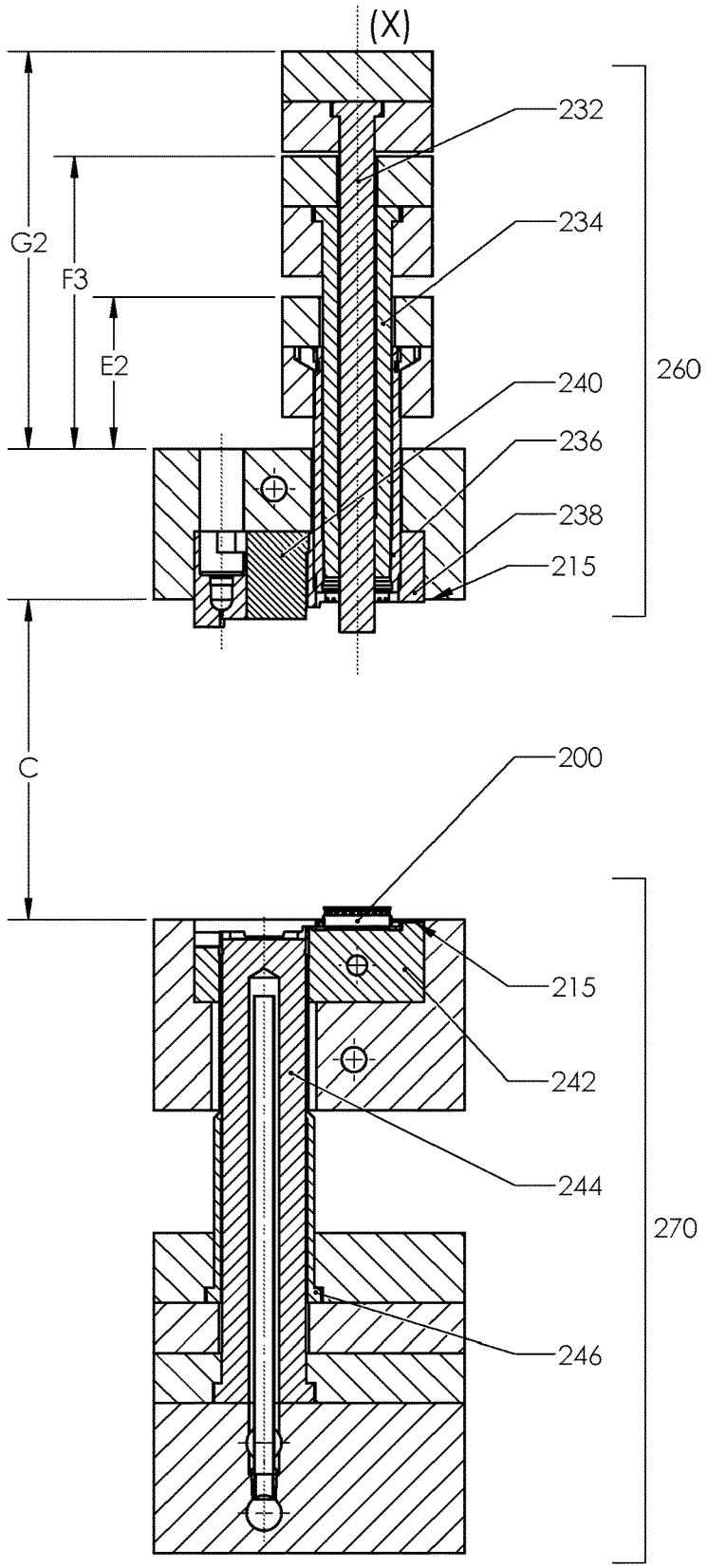

In FIG. 14D, the second mold half 270 is separated to a distance "C" from the first mold half 260. All internal components of the first and second mold halves 260 and 270 retain their relative positions, as in previous stages, with exception of the upper mold cavity pin 232, which moves forward relative to the upper mold cavity 238 from a distance "G1" to a distance "G2". With that motion, the closure 200 is completely released from the upper mold half 260 of the tool.

Figure 14E:
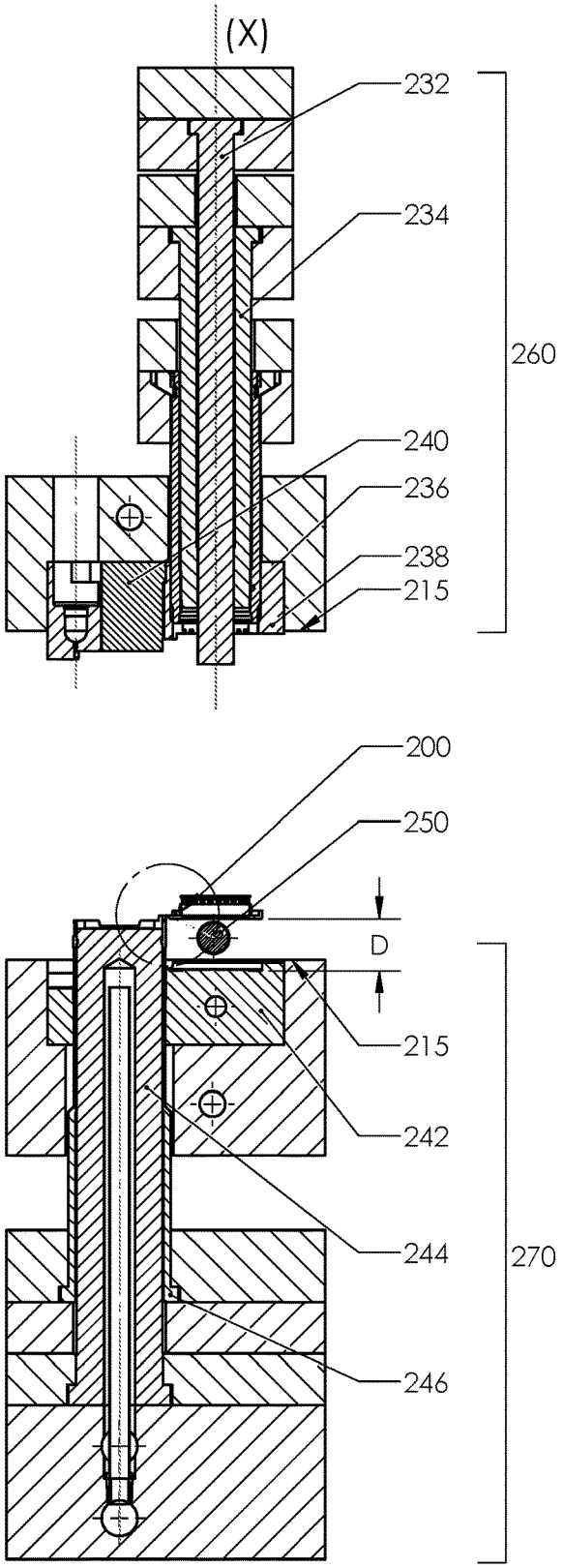

Referring to FIG. 14E, during a next stage of mold action, both the first and second mold halves 260 and 270 keep their relative position at distance "C".

Inside the second mold half 270, the lower core 244 and the lower mold cavity sleeve 246 move relative to the lower mold cavity 242 for a distance "D", in direction of the first mold half 260. By completing the stroke for the distance "D", the base 204 of closure 200 is completely removed out from the lower mold cavity 242 and the lid 202 is above the parting line 215.

As shown in FIG. 14E, a rod 250 of an in-mold closing apparatus is positioned under the lid 202. The closure 200 is held in place around the lower core 244 and on top of the lower mold cavity sleeve 246.

Figure 14F:
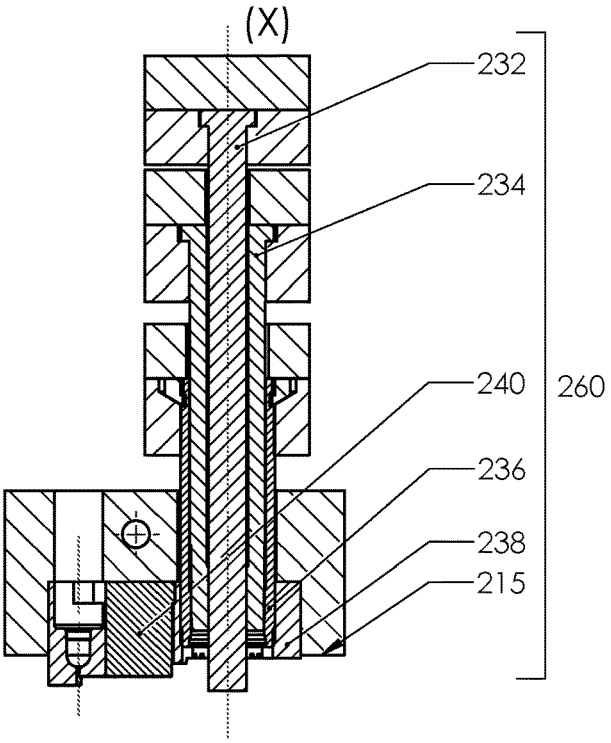
Figure 14F:
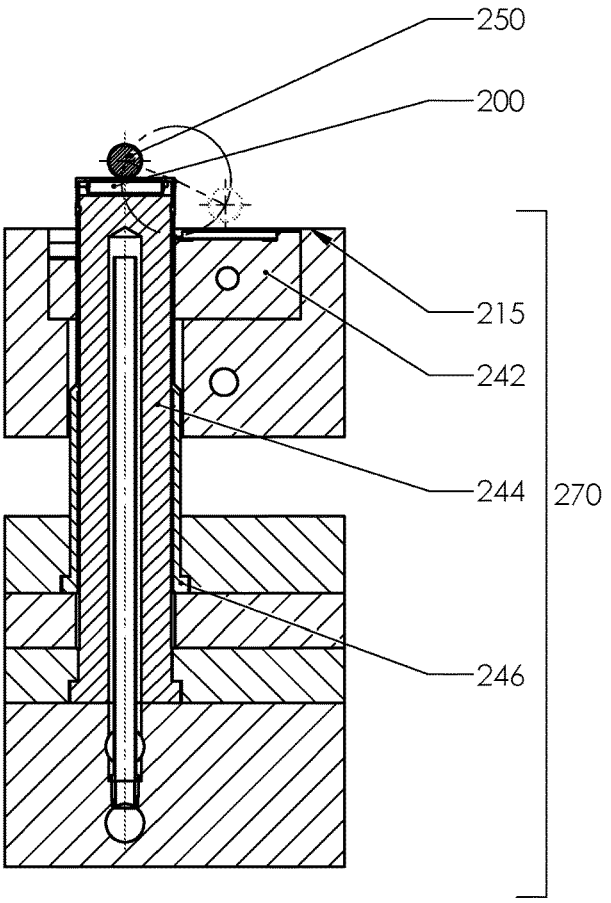

Referring to FIG. 14F, the rod 250 of the in-mold closing apparatus has completed its stroke of closing the lid 202 over the base 204 of the closure 200, and the rod 250 is moved away from closure 100 to allow for ejection.

Figure 14G:
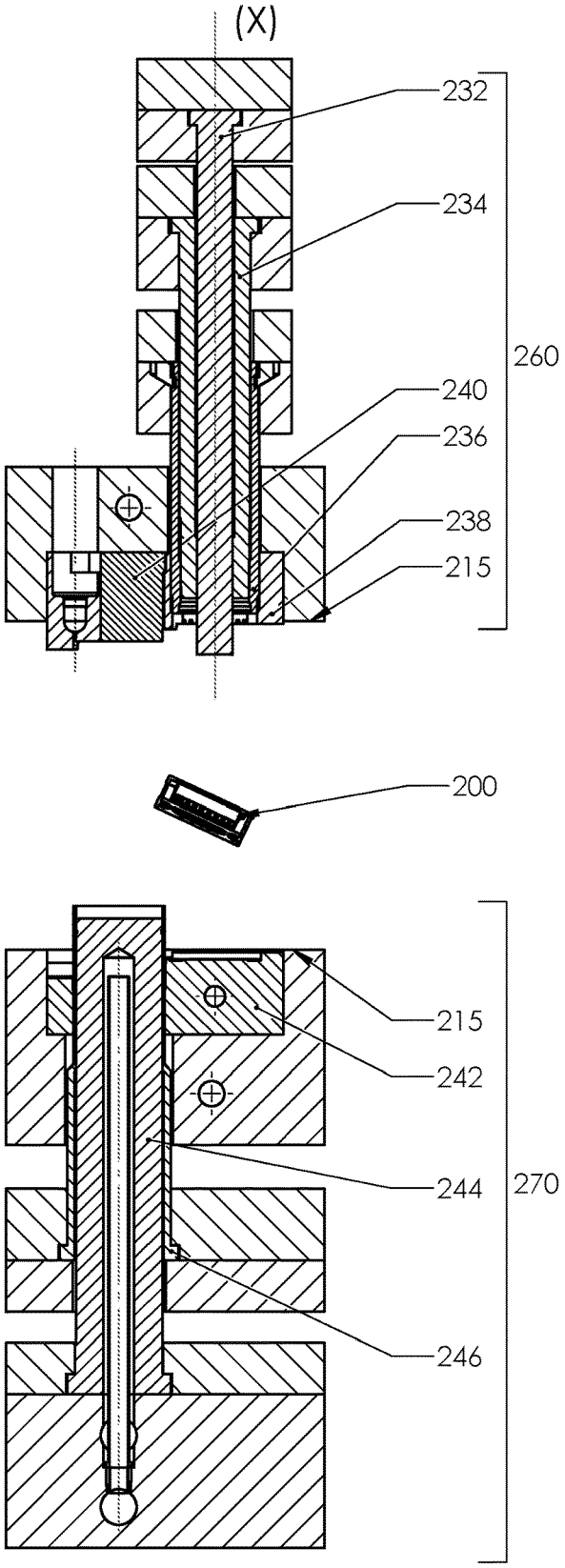

In FIG. 14G, the closure 200 is shown ejected by a relative motion of the lower mold cavity sleeve 246 towards the first mold half 260. The closure 200 is in closed state, ready to be assembled with a container.

While the invention has been shown and described with reference to a certain preferred embodiment thereof, it will be understood by those skilled in the art that various changes in form and details may be made therein without departing from the spirit and scope of the invention.

What is claimed is:

1. A closure for a container comprising:

a base having a cylindrical shape with at least one recessed area along a top perimeter of the base and a retaining ring near a bottom of the base;

a lid having an upper surface and a lower surface, and configured to close over and open off of the base; and at least one tab having an inner surface and an outer surface, the at least one tab extending from the lower surface of the lid and comprising a lip portion configured to fold back onto the at least one tab through contact with the base and lock with the base, when the lid is closed over the base, the at least one tab configured to detach from the lid when upward movement of the at least one tab is prevented by the base as the lid is opened from the base after the lid is closed over the base, and a portion of the outer surface of the at least one tab being visible through the at least one recessed area after the lid is closed over the base and remaining partially visible through the at least one recessed area after the at least one tab has detached from the lid, wherein the base further comprises at least one undercut region disposed surrounding the at least one recessed area and in which the at least one tab is disposed when the lid is closed over the base.

2. The closure of claim 1, further comprising a living hinge joining the base and the lid, wherein the base and the lid are maintained as connected prior to engagement of the lid with the base, after engagement of the lid with the base, and after opening the lid from the base after engagement.

3. The closure of claim 1, wherein a thickness of the at least one tab is decreased by cut-away sections that decrease in area on the outer surface and the inner surface as distance increases from the lower surface of the lid.

4. The closure of claim 1, wherein, prior to folding back onto the at least one tab, the lip portion is angled outwardly away from a center of the lid.

5. The closure of claim 1, wherein, upon full engagement of the closure with the neck of the container, the at least one tab is configured to be disposed between an inner surface of the base of the closure and the neck of the container, and the lip portion folded back onto the at least one tab is disposed between a side surface of the at least one undercut region, a lower surface of the at least one undercut region, and an upper surface of the at least one undercut region.

6. The closure of claim 5, wherein, upon opening the lid after the full engagement, the upper surface of the at least one undercut region prevents upward movement of the at least one tab and causes the at least one tab to detach from the lid.

7. The closure of claim 6, wherein, when the at least one tab detaches from the lid, the at least one tab drops further below the upper surface of the at least one undercut region until it contacts the lower surface of the at least one undercut region.

8. The closure of claim 1, further comprising at least one flange on an inner surface of the base located above the retaining ring and below the at least one recessed area.

9. The closure of claim 8, wherein, upon full engagement of the closure with the neck of the container, the at least one tab is configured to be disposed between the inner surface of the base of the closure, the neck of the container, and the at least one flange, and the lip portion folded back onto the at least one tab is disposed between a side surface of the at least one undercut region, a lower surface of the at least one undercut region, and an upper surface of the at least one undercut region.

10. The closure of claim 1, further comprising a plug seal extending from the lower surface of the lid within a perimeter of the at least one tab, the plug seal configured to seal a neck of the container upon full engagement of the closure with the neck of the container.

* * * * *